US008106846B2

(12) United States Patent
Kikin

(10) Patent No.: US 8,106,846 B2
(45) Date of Patent: Jan. 31, 2012

(54) COMPACT CIRCULAR POLARIZED ANTENNA

(75) Inventor: Vadim Kikin, Morgan Hill, CA (US)

(73) Assignee: Applied Wireless Identifications Group, Inc., Morgan Hill, CA (US)

( * ) Notice: Subject to any disclaimer, the term of this patent is extended or adjusted under 35 U.S.C. 154(b) by 468 days.

(21) Appl. No.: 12/434,549

(22) Filed: May 1, 2009

(65) Prior Publication Data

US 2010/0277389 A1 Nov. 4, 2010

(51) Int. Cl.
*H01Q 21/26* (2006.01)

(52) U.S. Cl. ..... 343/797; 343/895

(58) Field of Classification Search ..... 343/795, 343/797, 895

See application file for complete search history.

(56) References Cited

U.S. PATENT DOCUMENTS

| | | | | |
|---|---|---|---|---|
| 2,275,030 | A | 3/1942 | Epstein | 250/33 |
| 2,338,564 | A | 1/1944 | Aram | 250/33 |
| 2,412,090 | A | 12/1946 | Kibler | 250/33 |
| 2,420,967 | A | 5/1947 | Moore | 250/33 |
| 2,432,858 | A | 12/1947 | Brown | 250/11 |
| 2,511,611 | A | 6/1950 | Wheeler | 250/33.51 |
| 2,511,899 | A | 6/1950 | Brown | 250/33 |
| 2,516,706 | A | 7/1950 | Laport | 250/33 |
| 2,643,334 | A | 6/1953 | Aram | 250/33.53 |
| 2,810,127 | A | 10/1957 | Siukola | 343/797 |
| 3,015,101 | A | 12/1961 | Turner et al. | 343/848 |
| 3,083,364 | A | 3/1963 | Scheldorf | 343/843 |
| 3,196,443 | A | 7/1965 | Martin | |
| 3,388,400 | A | 6/1968 | Veldhuis | |
| 3,441,937 | A | 4/1969 | Clasby et al. | 343/895 |
| 3,484,724 | A | 12/1969 | Podell | 333/10 |
| 3,503,075 | A | 3/1970 | Gerst | |
| 3,514,780 | A | 5/1970 | Petrick et al. | 343/830 |
| 3,546,705 | A | 12/1970 | Lemson | 343/797 |
| 3,599,220 | A | 8/1971 | Dempsey | 343/845 |
| 3,624,658 | A | 11/1971 | Voronoff | 343/895 |
| 3,641,578 | A | 2/1972 | Spanos et al. | 343/773 |
| 3,701,157 | A | 10/1972 | Uhrig | 343/708 |
| 3,725,943 | A | 4/1973 | Spanos | 343/854 |
| 3,740,754 | A | 6/1973 | Epis | 343/797 |
| 3,771,162 | A | 11/1973 | Dienes | 343/806 |
| 3,789,416 | A | 1/1974 | Kuecken et al. | 343/792 |
| 3,805,266 | A | 4/1974 | Fletcher et al. | 343/708 |
| 3,811,127 | A | 5/1974 | Griffee et al. | 343/705 |
| 3,836,976 | A | 9/1974 | Monser et al. | 343/795 |

(Continued)

OTHER PUBLICATIONS

J. D. Kraus, *Antennas*, 2d Ed., McGraw-Hill, 1988, pp. 48-49, 726-729.

(Continued)

*Primary Examiner* — Tho G Phan
(74) *Attorney, Agent, or Firm* — Zilka-Kotab, PC

(57) ABSTRACT

According to one embodiment, an antenna comprises a plurality of elongated side radiating elements having longitudinal axes oriented at angles of between about 10 and about 80 degrees from a line perpendicular to an imaginary base plane extending across ends of the side radiating elements. In another embodiment, an antenna comprises a plurality of elongated side radiating elements each lying along a unique side plane and having longitudinal axes oriented at angles of between about 10 and about 80 degrees from a line perpendicular to an imaginary base plane extending across ends of the side radiating elements and a plurality of top radiating elements each electrically coupled to an associated one of the side radiating elements and lying along a top plane. Of course, many other systems and antennas according to other embodiments are included in the invention.

36 Claims, 28 Drawing Sheets

U.S. PATENT DOCUMENTS

| | | | | | |
|---|---|---|---|---|---|
| 3,906,509 | A | | 9/1975 | DuHamel | 343/895 |
| 3,919,710 | A | * | 11/1975 | Fletcher et al. | 343/770 |
| 3,932,874 | A | * | 1/1976 | Woodward | 343/795 |
| 3,940,772 | A | | 2/1976 | Ben-dov | 343/853 |
| 3,943,522 | A | | 3/1976 | Ben-Dov | 343/797 |
| 4,008,479 | A | | 2/1977 | Smith | 343/895 |
| 4,012,744 | A | | 3/1977 | Greiser | 343/895 |
| 4,031,539 | A | | 6/1977 | Woodward | 343/797 |
| 4,062,019 | A | * | 12/1977 | Woodward et al. | 343/797 |
| 4,114,164 | A | | 9/1978 | Greiser | 343/895 |
| 4,163,981 | A | | 8/1979 | Wilson | 343/715 |
| 4,204,212 | A | | 5/1980 | Sindoris et al. | 343/700 |
| 4,295,144 | A | | 10/1981 | Matta et al. | 343/895 |
| 4,349,824 | A | | 9/1982 | Harris | 343/700 |
| 4,426,649 | A | | 1/1984 | Dubost et al. | 343/700 |
| 4,431,998 | A | | 2/1984 | Finken | 343/797 |
| 4,554,554 | A | | 11/1985 | Olesen et al. | 343/895 |
| 4,578,652 | A | | 3/1986 | Sterns | 333/117 |
| 4,686,536 | A | * | 8/1987 | Allcock | 343/700 MS |
| 4,851,795 | A | | 7/1989 | Beckwith | 333/100 |
| 4,878,062 | A | | 10/1989 | Craven et al. | 343/872 |
| 5,134,422 | A | | 7/1992 | Auriol | 343/895 |
| 5,170,176 | A | | 12/1992 | Yasunaga et al. | 343/895 |
| 5,173,715 | A | | 12/1992 | Rodal et al. | 343/795 |
| 5,191,352 | A | | 3/1993 | Branson | 343/895 |
| 5,198,831 | A | | 3/1993 | Burrell et al. | 343/895 |
| 5,255,005 | A | | 10/1993 | Terret et al. | 343/895 |
| 5,346,300 | A | | 9/1994 | Yamamoto et al. | 343/895 |
| 5,349,365 | A | | 9/1994 | Ow et al. | 343/895 |
| 5,481,272 | A | | 1/1996 | Yarsunas | 343/797 |
| 5,594,461 | A | | 1/1997 | O'Neill, Jr. | 343/895 |
| 5,635,945 | A | | 6/1997 | McConnell et al. | 343/895 |
| 5,721,557 | A | | 2/1998 | Wheeler et al. | 343/895 |
| 5,793,338 | A | | 8/1998 | Standke et al. | 343/895 |
| 5,796,372 | A | | 8/1998 | Elliot | 343/797 |
| 5,828,348 | A | | 10/1998 | Tassoudji et al. | 343/895 |
| 5,854,608 | A | | 12/1998 | Leisten | 343/895 |
| 5,859,621 | A | | 1/1999 | Leisten | 343/895 |
| 5,872,549 | A | | 2/1999 | Huynh et al. | 343/895 |
| 5,920,292 | A | | 7/1999 | O'Neill, Jr. | 343/895 |
| 5,945,963 | A | | 8/1999 | Leisten | 343/895 |
| 5,963,180 | A | | 10/1999 | Leisten | 343/895 |
| 5,986,616 | A | | 11/1999 | Edvardsson | 343/853 |
| 5,986,620 | A | | 11/1999 | Filipovic | 343/895 |
| 5,990,847 | A | | 11/1999 | Filipovic et al. | 343/895 |
| 6,005,521 | A | | 12/1999 | Suguro et al. | 343/700 |
| 6,034,650 | A | | 3/2000 | Kuramoto | 343/895 |
| 6,072,441 | A | | 6/2000 | Tanabe | 343/895 |
| 6,075,501 | A | | 6/2000 | Kuramoto et al. | 343/895 |
| 6,088,000 | A | | 7/2000 | Ho | 343/770 |
| 6,094,178 | A | | 7/2000 | Sanford | 343/895 |
| 6,097,349 | A | | 8/2000 | Sanford | 343/859 |
| 6,133,891 | A | | 10/2000 | Josypenko | 343/895 |
| 6,150,981 | A | | 11/2000 | Suguro et al. | 343/700 |
| 6,150,994 | A | | 11/2000 | Winter et al. | 343/895 |
| 6,154,184 | A | | 11/2000 | Endo et al. | 343/895 |
| 6,160,523 | A | | 12/2000 | Ho | 343/770 |
| 6,172,656 | B1 | | 1/2001 | Ohwada et al. | 343/895 |
| 6,181,295 | B1 | | 1/2001 | Sharaiha et al. | 343/895 |
| 6,181,297 | B1 | | 1/2001 | Leisten | 343/895 |
| 6,184,844 | B1 | | 2/2001 | Filipovic et al. | 343/895 |
| 6,184,845 | B1 | | 2/2001 | Leisten et al. | 343/895 |
| 6,204,827 | B1 | | 3/2001 | Endo et al. | 343/895 |
| 6,211,840 | B1 | | 4/2001 | Wood et al. | 343/793 |
| 6,222,505 | B1 | | 4/2001 | Endo et al. | 343/895 |
| 6,229,498 | B1 | | 5/2001 | Matsuyoshi et al. | 343/895 |
| 6,229,499 | B1 | | 5/2001 | Licul et al. | 343/895 |
| 6,232,929 | B1 | | 5/2001 | Ermutlu et al. | 343/895 |
| 6,246,379 | B1 | | 6/2001 | Josypenko | 343/895 |
| 6,259,420 | B1 | | 7/2001 | Bengtsson et al. | 343/895 |
| 6,288,686 | B1 | | 9/2001 | Josypenko | 343/895 |
| 6,300,917 | B1 | | 10/2001 | Leisten et al. | 343/895 |
| 6,333,722 | B1 | | 12/2001 | Kitano | 343/895 |
| 6,339,408 | B1 | | 1/2002 | Edvardsson et al. | 343/895 |
| 6,344,834 | B1 | | 2/2002 | Josypenko | 343/895 |
| 6,369,776 | B1 | | 4/2002 | Leisten et al. | 343/895 |
| 6,421,028 | B1 | | 7/2002 | Ohgren et al. | 343/895 |
| 6,421,029 | B1 | | 7/2002 | Tanabe | 343/895 |
| 6,424,316 | B1 | | 7/2002 | Leisten | 343/895 |
| 6,433,755 | B1 | | 8/2002 | Kuramoto | 343/895 |
| 6,480,173 | B1 | | 11/2002 | Marino | 343/895 |
| 6,545,649 | B1 | | 4/2003 | Seavey | 343/895 |
| 6,552,693 | B1 | | 4/2003 | Leisten | 343/895 |
| 6,587,081 | B2 | | 7/2003 | Noro et al. | 343/895 |
| 6,653,987 | B1 | | 11/2003 | Lamensdorf et al. | 343/895 |
| 6,720,935 | B2 | | 4/2004 | Lamensdorf et al. | 343/895 |
| 6,759,990 | B2 | | 7/2004 | Rossman | 343/700 |
| 6,765,541 | B1 | | 7/2004 | Josypenko | 343/895 |
| 6,784,850 | B2 | | 8/2004 | Morooka et al. | 343/895 |
| 6,784,851 | B2 | | 8/2004 | Merrill | 343/895 |
| 6,791,509 | B2 | | 9/2004 | Noro | 343/895 |
| 6,886,237 | B2 | | 5/2005 | Leisten et al. | 29/600 |
| 6,914,580 | B2 | | 7/2005 | Leisten | 343/895 |
| 7,142,170 | B2 | | 11/2006 | Saunders et al. | 343/895 |
| 7,151,505 | B2 | | 12/2006 | Jostell et al. | 343/895 |
| 7,180,472 | B2 | | 2/2007 | Yegin et al. | 343/895 |
| 7,253,787 | B2 | | 8/2007 | Liu et al. | 343/895 |
| 7,256,752 | B2 | | 8/2007 | Wither et al. | 343/905 |
| 7,372,427 | B2 | | 5/2008 | Leisten | 343/895 |

OTHER PUBLICATIONS

GeoHelix P2 Product Specification V6 Issue Nov. 2006 Sarantel Ltd. (HQ) Unit 2, Wendel Point Ryle Drive, Park Farm South Wellingborough, NN8 6BA United Kingdom.

Lap K.Yeung et al. "Mode-Based Beamforming Arrays for Miniaturized Platforms" IEEE Transactions on Microwave Theory and Techniques, Jan. 2009, vol. 57, pp. 45-52.

Kai Chang and Lung-Hwa Hsieh "Microwave Ring Circuit and Related Structures" John Wiley & Sons 2004, pp. 197-240.

Fusco, V.F. and S.B.D. O'Caireallain "Lumped Element Hybrid Networks for GaAs MMICs" Microwave Optical Tech. Lett., vol. 2, Jan. 1989 pp. 19-23.

Parisi, S.J., "A Lumped Element Rat Race Coupler", Applied Microwave Aug./Sep. 1989 pp. 85-93.

Wilfred N. Caron "Antenna Impedance Matching" The American Radio Relay League, 1989, pp. 4.1-4.11, 5.1-5.17.

Parisi, Samuel J., "180 Degrees Lumped Element Hybrid," 1989 IEEE, IEEE MTT-S Digest, PP-33, p. 1243-1246.

* cited by examiner

| Name | Freq | Ang | Mag | RX |
|---|---|---|---|---|
| m1 | 0.9150 | -116.0358 | 0.0233 | 0.9789 - 0.0410i |
| m2 | 0.8800 | -8.6098 | 0.5537 | 3.2762 - 0.7833i |
| m3 | 0.9600 | 56.4470 | 0.5897 | 0.9372 + 1.4125i |

| Name | Freq | Ang | Mag | RX |
|---|---|---|---|---|
| m1 | 0.9150 | -132.1003 | 0.0065 | 0.9912 - 0.0095i |
| m2 | 0.8000 | 02.4289 | 0.1020 | 1.0804 + 0.1974i |
| m3 | 0.9600 | -107.1431 | 0.0612 | 0.9581 - 0.1125i |

COMPACT CIRCULAR POLARIZED ANTENNA

FIELD OF THE INVENTION

This invention is related to antennas, and more particularly to compact size antennas with linear dimensions less than a quarter of a wavelength, radiated in the free space, providing the circular polarization of radiation within a wide range of frequencies with good polarization quality.

BACKGROUND OF THE INVENTION

New applications of antennas for use in Radio Frequency Identification (RFID) devices are imposing difficult and controversial requirements on antenna specifications.

Antennas used in passive Radio Frequency Identification Systems deliver enough energy to the passive tag in a certain frequency band to power the tag, to transmit the required commands from the interrogator to the tag, and to receive the response from the tag in the form of a backscattered wave. In the case of passive tags, there is no other method of energy delivery beyond the antenna.

Typical operational frequencies include 433-435 MHz, 865-870 MHz, 902-928 MHz, 952-955 MHz, 2400-2500 MHz, 5700-5900 MHz and the level of the radiated energy is between 0.01 Watt EIRP and 4.0 Watt EIRP, and are defined and limited by the government regulations for RFID applications.

One feature of the passive RFID system, which distinguishes it from the other wireless communication systems, is that the transceiver transmits energy and information and receives backscattered signals from the tags at the same time and on the same frequency.

FIG. 1 illustrates a prior art RFID system, its components and signals. Similar to other wireless communication systems, the input port 10 of antenna 1 is connected to the transceiver 2 through the transmission line 3, which may be a coaxial cable, microstrip line, etc.

The transceiver transmits the signal with the power level $P_{transmit}$ to the antenna 1. Most of the transmitted energy will be radiated from the antenna into the space. A small portion of the transmitted energy will be reflected back from the not perfectly matched input port 10 of antenna 1 to the transceiver 2. The amount of this reflected energy is defined as return loss, or voltage standing wave ratio (VSWR), of the antenna.

Conventional wireless communication systems, in which the transmitted signal and the received signal are separated in time and/or by the frequency of the carrier, may employ antennas with VSWR in the range of about 1.5 to about 2.0, because more than 90% of transceiver power will be accepted by the antenna.

For RFID systems, such a value of VSWR may be too high, as the part of the noisy transmitted signal is coming back to the sensitive receiver. This will degrade the performance of an RFID system, where a noise floor is defined not by the noise figure of the receiver low noise amplifier (LNA) or the mixer, but by the portion of the signal from the transmitter that is "leaked" into the receiver.

Antennas preferably have a VSWR of less than about 1.20 for RFID applications. For instance, the reduction of antenna VSWR from 2.0 to 1.2 may increase the signal to noise ratio in the receiver by 11.3 dB. This increase in the signal to noise ratio may significantly reduce the errors of decoding of the signals coming from the tags and increase the speed of interrogation.

The portion of the power from the transmitter, which is accepted by the antenna, may be radiated into space with some correction in regard to the efficiency of the antenna. Radiated energy will be distributed in the volume of the space according to the radiation pattern of the antenna.

The interrogated tags 4, 5, 6 are usually positioned randomly in a volume of space. The maximum interrogation distance from the antenna to the tag is related to the minimum power that is needed to turn on or activate the integrated circuit of the tag, by the maximum power generated in the transceiver 2 of the RFID interrogator, and by the maximum realized gain of the antenna 1 and the radiation pattern of the antenna 1.

The maximum interrogation distance in free space is well defined, and is further described in "Friis Transmission Equation" (J. D. Kraus, *Antennas,* 2d Ed., McGraw-Hill, 1988, pp. 48-49). The radiation pattern of the antenna defines the maximum interrogation distances at angles other than at the boresight direction Z. Boresight is the optical axis of a directional antenna.

Traditionally the width of the radiation pattern is defined by the level where the gain of the antenna falls by 3 dB relative to the maximum gain. For a RFID system, such a definition is too coarse. With the 3 dB gain variation, the maximum interrogation distance will vary more than about 30%, estimated for free space with the "Friis Transmission Equation." A more practical definition for RFID systems is that the maximum distance variation is less than 10%. This may be translated in the antenna gain variation as less than 1 dB. In FIG. 1, the angle $\theta$ represents the width of the pattern, where the realized gain of the antenna falls by 1 dB.

Most of the tags employed in RFID systems are electrical dipoles connected to the passive RFID integrated circuit. Such tags are sensitive to the polarization of the wave of radiated energy. If the polarization of the radiated wave will be linear the maximum interrogation distance will depend on the angle $\Phi$ between polarization of the radiated wave and the tag position. This maximum distance will vary from 0 to a maximum with $\Phi$ variations from 90° to 0°. That is why most of the typical RFID systems employ circular polarized antennas. To reduce the performance degradation of RFID systems, the antenna has to provide the variation of maximum interrogation distance of less than 10% for any angle $\Phi$ for a position of the tag relative to the antenna.

In terms of parameters of the antenna, the axial ratio of the antenna has to be less than 1 dB within the interrogation angle $+/-\theta$ from boresight axis Z.

Government regulations allow interrogation on the particular frequency or channel during a short period of time only. After that, the interrogator changes the frequency of the carrier or interrogation channel within the defined Frequency Band. That means that the, antenna for RFID systems may provide radiation frequency bandwidth, within which the variation of the maximum interrogation distance is less than about 10%. Or, the radiation frequency bandwidth of the antenna may be defined as the antenna gain level at a point where it falls off by 1 dB relative to the maximum gain.

Another area of consideration of the antenna specification is if the antenna is portable and/or wearable. This imposes additional desirable characteristics, such as the minimum weight and the minimum size and/or volume of the antenna. Very often, the antenna is designed to fit into an existing portable device, with a position and a space to install the antenna defined before the antenna is designed.

Portable and/or wearable applications assume that the body of the user is close to the antenna and within a relative strong electromagnetic field. That means that the user will absorb some energy radiated from the antenna, and will provide some influence on the antenna parameters, such as VSWR, the Maximum Realized Gain and the Radiation Pattern. This point of view increases the value of the front to back ratio of radiation from the antenna.

At the present moment, many circular polarized antennas have been developed. But not one of them satisfies the characteristics and parameters presented above.

Full size circular polarized patch antennas with dimensions from ($\lambda\times\lambda\times\lambda/16$) to ($\lambda/2\times\lambda/2\times\lambda/32$), where $\lambda$ is the free space wavelength of a radio frequency, provide relatively high realized gains of up to 8 to 9 dBic or 5 to 6 dBi. The size is defined by the conductive ground plane size and it is relative to the free space wavelength $\lambda$ of radiated signal at the central frequency. The frequency bandwidth of such antennas is +/−3% to +/−3.5% at the −1 dB level from the maximum realized radiation gain. The front to back ratio is defined by the size of the ground plane and it is within from about 12 dB to about 18 dB, typically.

Polarization quality and/or axial ratio may be within about 1 dB, if the feeding circuit of the antenna employs a good quality 90° hybrid power divider. One drawback of these antennas is the size and the weight of the conductive ground plane. It is too large and heavy for most portable applications.

Small patch antennas with the small ground plane which employ a ceramic substrate with a high dielectric constant may be designed to fit into a volume defined by $\lambda/5\times\lambda/5\times\lambda/32$, or less. However, this type of antenna may be quite heavy, because of the high density of the ceramic substrate and it may possess a very narrow frequency bandwidth of about +/−0.6% or less from the central frequency at the level −1 dB from the maximum radiation gain. The front to back ratio may also be very poor, about 1 dB to about 2 dB only. Polarization quality and/or axial ratio also depends on surrounding objects and will be within from about 2 db to about 4 dB. The VSWR is typically above about 1.3 to about 1.5 within the frequency band.

Helical, helix and/or quadrifilar helix antennas do not use a conductive ground plane and because of this, the footprint may be much smaller than the footprint of patch antennas. A typical size of a quadrifilar helix is from $\lambda/6\times\lambda/6\times\lambda/6$ to $\lambda5/\times\lambda/5\times\lambda/2$ or thicker. A thicker antenna provides a wider frequency bandwidth. An antenna with longer radiating elements wound around a cylinder provides a higher gain, but a narrower radiation frequency bandwidth.

The frequency bandwidth of such antennas is about +/−1.5% to about +/−2.5% at the −1 dB level from the maximum realized radiation gain. The front to back ratio is within from about 10 dB to about 16 dB typically. Polarization quality is very good and the axial ratio may be less than about 1 dB, if the feeding circuit of the antenna employs a good quality quadrature (0°, −90°, −180°, −270°) hybrid power divider.

One of the disadvantages of using a helical antenna is the length and/or thickness of the structure. The structure does not fit into small portable designs. Squeezing the thickness less than $\lambda/6$ by reducing the pitch will dramatically reduce the frequency bandwidth. The size may be reduced by employing the central core with a high dielectric material. However, using a high dielectric material increases the weight of antenna and reduces the radiation frequency bandwidth to about 1% or less and reduces the realized gain at the same time. See GeoHelix P2 Product Specification V6 Issue 11-06 Sarantel Ltd. (HQ) Unit 2, Wendel Point Ryle Drive, Park Farm South Wellingborough, NN8 6BA United Kingdom. See also U.S. Pat. No. 7,372,427 "Dielectrically-Loaded Antenna" & U.S. Pat. No. 6,886,237 "Method of Producing an Antenna," which are hereby incorporated by reference.

Another disadvantage of using a helical antenna is the cylindrical shape. The radiation elements wrap around the supporting cylinder. If the cylinder is not perfectly shaped, such as being elliptical, it distorts the radiation pattern, increases the axial ratio of radiated field and the impedances of the radiation elements will be not equal, which will increase the VSWR at the input port. The pitch of the radiating elements or distance between them also impacts the operation, as a little inaccuracy or instability can affect the operation. Sometimes, this inaccuracy can distort the pattern, can disbalance the impedances of the radiating elements, and can increase the VSWR. To produce the antenna with the radiating elements accurately wrapped around the cylinder, special technology is used other than the standard flat PCB manufacturing process adopted for patch antenna production. See U.S. Pat. No. 6,886,237 "Method of Producing an Antenna," which is hereby incorporated by reference. This increases the cost of producing helical antennas relative to producing patch antennas.

Another type of circular polarized antenna is a crossed dipole antenna or turnstile antennas, as shown in FIG. 2. See U.S. Pat. No. 2,511,899 "Antenna System," which is hereby incorporated by reference. See also J. D. Kraus, *Antennas,* 2nd Ed., McGraw-Hill, 1988, pp. 726-729. When this antenna has a good quality quadrature (0°, −90°, −180°, −270°) hybrid divider 8, it provides good polarization quality within a wide frequency bandwidth. The size of this antenna W is defined by the length of the dipole and is typically about $\lambda/2$, half of the wavelength in the free space.

The radiation pattern of the right hand circular polarized (RHCP) component is presented in FIGS. 3A and 3B. With phases 0°, −90°, −180°, −270° of the feeding signals at the radiating elements 7, the RHCP component propagates in the positive Z-direction. Unfortunately, the LHCP or cross-polarized component is as strong as the RHCP, but propagates in the opposite Z-direction. That is why the $\theta$ component of the electromagnetic field propagates in both positive and negative Z-directions. However, this is a waste of energy from the RFID system point of view.

The $\theta$ component of the electromagnetic field represents the component which provides the coupling with the linear polarized antenna of the RFID tag.

It is advantageous to concentrate the propagation in one direction only. One solution to accomplish this is to position the crossed dipoles above the conductive plane or inside of the conductive cup. See U.S. Pat. No. 3,740,754 "Broadband Cup-Dipole and Cup-Turnstile Antennas," which is hereby incorporated by reference. But this solution increases the size of the antenna further and makes it less capable of being used in portable applications.

To reduce the size, some antennas proposed to bend the dipoles. See U.S. Pat. No. 6,211,840 "Crossed-Drooping Bent Dipole Antenna" & U.S. Pat. No. 4,686,536 "Crossed-Drooping Dipole Antenna," which are hereby incorporated by reference. Such antennas have a smaller footprint, but the ground plane is still large and the overall structure is generally too thick for portable applications.

The way to reduce the footprint of the antenna further is to completely fold the dipoles 7 of turnstile antenna and position the dipoles 7 above the small size ground plane. The antenna appears as four monopoles above the small ground plane. See Lap K. Yeung et al. "Mode-Based Beam Forming Arrays for Miniaturized Platforms" IEEE Transactions on Microwave Theory and Techniques, January 2009, volume 57, pp. 45-52. This type of antenna system is presented in FIG. 4.

The radiating elements 7 are the thin strips of conductive material. These strips are positioned on the surface of thin dielectric substrates 9. The purpose of the dielectric substrate is to provide stability of radiating elements 7 in space. The combination of radiating elements and dielectric substrates may be produced through standard PCB manufacturing processes. The substrates 9 are assembled as a box, which provides a rigid, stable, and low weight structure. One end of the radiating elements is connected to the feeding circuit 8. The feeding circuit 8 divides the input signal into four signals with equal amplitude and phases (0°, −90°, −180°, −270°).

Such an antenna system poses the radiating patterns presented in FIGS. 5A and 5B similar to the conventional turnstile antenna. The RHCP component propagates in the positive Z-direction and the LHCP and/or cross-polarized component is as strong as the RHCP, and propagates in the opposite Z-direction.

The θ component has an almost omni-directional radiation pattern. For some applications it may be useful, but from a RFID point of view, it is a waste of energy, with loss of the antenna gain and reduced interrogation range.

SUMMARY OF THE INVENTION

According to one embodiment, an antenna comprises a plurality of elongated side radiating elements having longitudinal axes oriented at angles of between about 10 and about 80 degrees from a line perpendicular to an imaginary base plane extending across ends of the side radiating elements.

In another embodiment, an antenna comprises a plurality of elongated side radiating elements each lying along a unique side plane and having longitudinal axes oriented at angles of between about 10 and about 80 degrees from a line perpendicular to an imaginary base plane extending across ends of the side radiating elements and a plurality of top radiating elements each electrically coupled to an associated one of the side radiating elements and lying along a top plane.

A system in another embodiment comprises a feeding circuit and a plurality of side radiating elements coupled to the feeding circuit, the side radiating elements having longitudinal axes oriented at angles of between about 10 and about 80 degrees from a line perpendicular to an imaginary base plane extending across ends of the side radiating elements. The system also includes a plurality of top radiating elements electrically coupled to the side radiating elements, each of the top radiating elements having a different orientation than the associated side radiating element.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

Various embodiments of the present invention are described in further detail below with reference to the figures, in which like items are numbered the same in the several figures.

DETAILED DESCRIPTION

The following description is the best mode presently contemplated for carrying out the present invention. This description is made for the purpose of illustrating the general principles of the present invention and is not meant to limit the inventive concepts claimed herein. Further, particular features described herein can be used in combination with other described features in each of the various possible combinations and permutations.

It must also be noted that, as used in the specification and the appended claims, the singular forms "a," "an" and "the" include plural referents unless otherwise specified.

According to one general embodiment, an antenna comprises a plurality of elongated side radiating elements having longitudinal axes oriented at angles of between about 10° and about 80° from a line perpendicular to an imaginary base plane extending across ends of the side radiating elements.

In another general embodiment, an antenna comprises a plurality of elongated side radiating elements each lying along a unique side plane and having longitudinal axes oriented at angles of between about 10° and about 80° from a line perpendicular to an imaginary base plane extending across ends of the side radiating elements; and a plurality of top radiating elements each electrically coupled to an associated one of the side radiating elements and lying along a top plane.

In another general embodiment, a system comprises a feeding circuit; a plurality of side radiating elements coupled to the feeding circuit, the side radiating elements having longitudinal axes oriented at angles of between about 10 and about 80 degrees from a line perpendicular to an imaginary base plane extending across ends of the side radiating elements; and a plurality of top radiating elements electrically coupled to the side radiating elements, each of the top radiating elements having a different orientation than the associated side radiating element.

Figure 6:
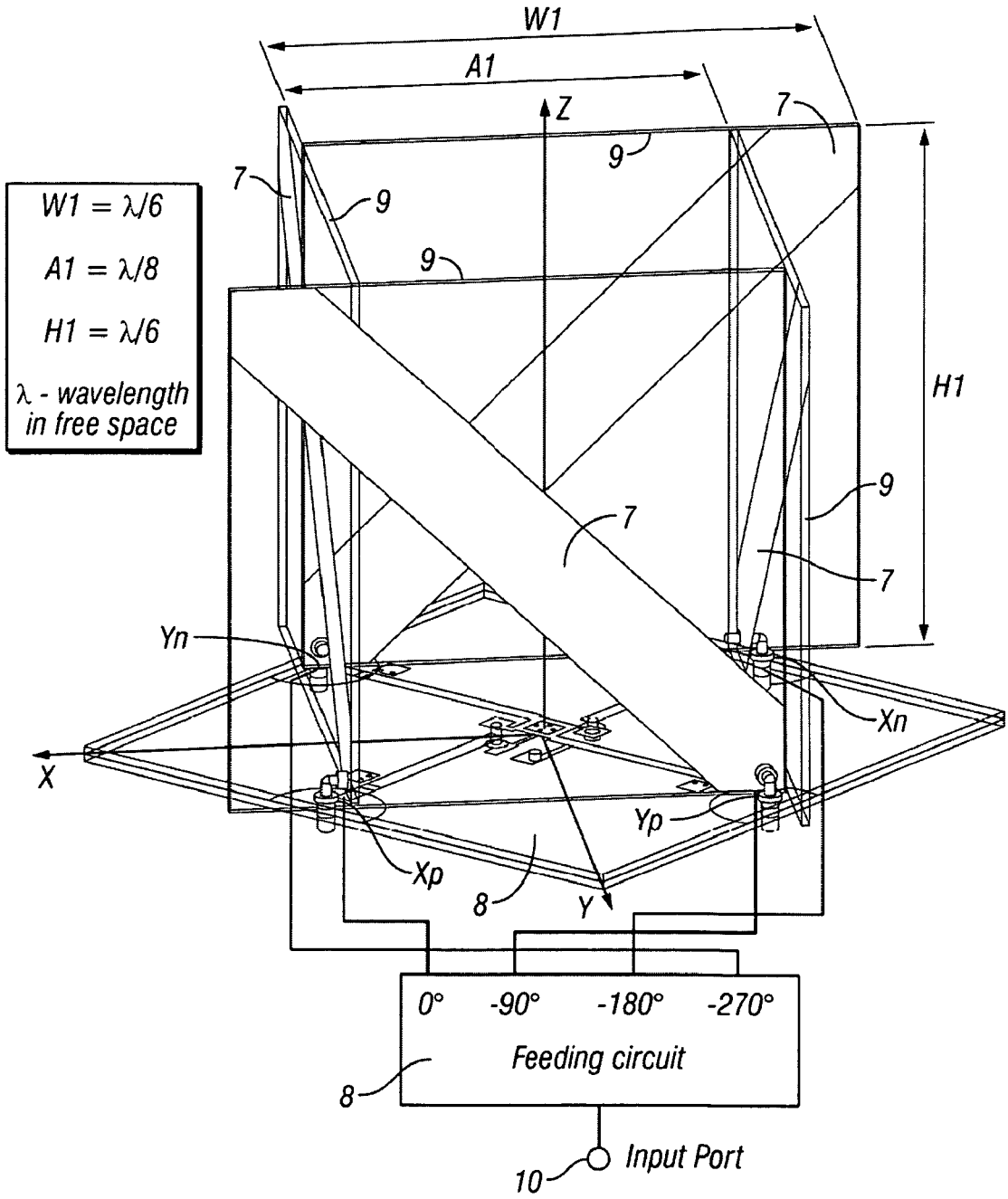
FIG. 6 is an isometric view of an antenna according to one embodiment.

FIG. 6 is an isometric view of an antenna according to one embodiment. The antenna in this embodiment comprises four side radiating elements 7. Each antenna includes a plurality of elongated side radiating elements 7 having longitudinal axes including a median longitudinal axis for a side radiating element 7 having a nonlinear profile oriented at angles of between about 10° and about 80° from a line perpendicular to the feeding circuit plane XY extending across ends of the side radiating elements 7.

The side radiating elements 7 may be identical, nearly identical, or different. Also, there may be embodiments where there are more or less than four side radiating elements. The bottom part of each radiating element 7 begins from the feeding circuit plane XY and extends into the positive boresight Z-direction to its top end.

The length of each radiating element 7 may be about $\lambda/4$, where $\lambda$ is the free space wavelength of radiation at a middle frequency of an operational frequency band of the antenna, and may vary within about +/−10%.

In some embodiments, the side radiating elements 7 each lie along a unique side plane. For example, each of the four side radiating elements 7 are shifted from the boresight axis Z along the feeding circuit plane XY from the central point of this plane in the quadrate directions 45°, 135°, 225°, 315° relative to the X axis. However, the quadrate directions are not limited by specified values and may be, for example, 0°, 90°, 180°, 270°; 30°, 120°, 210°, 300°, etc. The value of the shift from the central point of the XY plane to the bottom part of radiating elements 7 may be about $\lambda/2.7$ and may vary within about +/−30%. In some further embodiments, supporting substrates may be coupled to the side radiating elements 7, each of the substrates lying in the side plane of the associated side radiating element 7.

To compensate the cross polarized component of radiation and to concentrate most of the radiated energy into the positive boresight direction Z, each side radiating element 7 may be tilted relative to a line perpendicular to the feeding circuit plane XY in a direction opposite to a rotation of the electrical component of a field radiated by the antenna. This would be in a counter clockwise direction creating a Right Hand Circular Polarization (RHCP) if the viewer is looking into the positive boresight direction (direction of propagation) Z. The angle of the tilt in FIG. 6 is about 45° relative to the XY plane, and may be from about 5° to about 85°.

The feeding circuit 8 with the four output ports Xp, Yp, Xn, Yn, which are electrically connected to the bottom part of radiating elements 7 in the XY plane, provides the four signals, which are equal by amplitude and have relative phases 0°, −90°, −180°, −270° distributed between the side radiating elements 7 in the clockwise direction.

In another possible embodiment of a Left Hand Circular Polarized (LHCP) antenna, the side radiating elements 7 may be tilted in the clockwise direction and the feeding circuit 8 may provide four signals, which are equal by amplitude and have relative phases 0°, −90°, −180°, −270° distributed between the side radiating elements 7 in the counter clockwise direction.

The feeding circuit 8 is the power divider/combiner with one input port 10 and four output ports Xp, Yp, Xn, Yn. The main function of this feeding circuit 8 is to accept the input power and distribute it between the four output ports with equal amplitudes and relative phases in quadrate 0°, −90°, −180°, −270° within the operational frequency band. Other characteristics of the feeding circuit 8, such as low VSWR, isolation between ports, and low ripple of transfer functions and low phase variation within the operational frequency band are useful, but should not limit the embodiment in any way.

In a receiving antenna, when energy flows in the opposite direction, the feeding circuit 8 may be considered as a power combiner from ports Xp, Yp, Xn, Yn into port 10.

The feeding circuit 8 may be the combination of transmission lines with the different lengths as used in the prior art. See U.S. Pat. No. 2,412,090 "Turnstile Antenna," U.S. Pat. No. 2,511,899 "Antenna System," & U.S. Pat. No. 3,906,509 "Circularly Polarized Helix and Spiral Antennas," which are hereby incorporated by reference. Or, the feeding circuit 8 may be the combination of a balun and/or a hybrid divider or hybrid coupler circuit.

Figure 8:
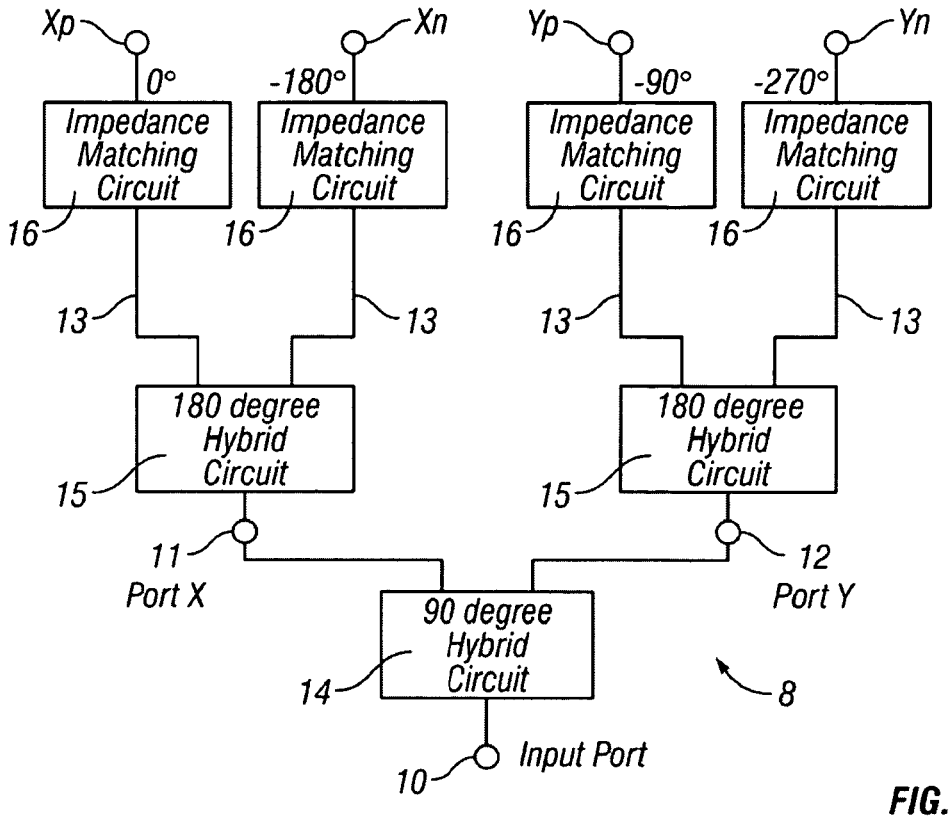
FIG. 8 is a block diagram of a feeding circuit according to one embodiment.

Now referring to FIG. 8, a block diagram of one possible embodiment of the feeding circuit 8 is shown. The input port 10 is the port of the 90° hybrid circuit 14. The two outputs of the hybrid circuit 14 are connected to the input Port X 11 and input Port Y 12 of two 180° Hybrid circuits 15. The internal isolated ports of the 90° and the 180° hybrid circuits 14, 15 are loaded by resistors, with a proper value.

The four outputs of the 180° hybrid circuits 15 are connected to the inputs of the impedance matching circuits 16 through the four transmission lines 13. The outputs of the matching circuits 16 are output ports Xp, Yp, Xn, Yn.

The 90° and 180° hybrid circuits 14, 15 may be realized with a transmission line technique. See U.S. Pat. No. 3,484,724 "Transmission Line Quadrature Coupler" & U.S. Pat. No. 4,578,652 "Broadband Four-Port TEM Mode 180° Printed Circuit Microwave Hybrid," which are hereby incorporated by reference. See also Kai Chang and Lung-Hwa Hsieh "Microwave Ring Circuit and Related Structures" John Wiley & Sons 2004, pp. 197-240.

For smaller sizes, the 90° and 180° hybrid circuits 14, 15 may be produced with a lumped components technique. See U.S. Pat. No. 4,851,795 "Miniature Wide-Band Microwave Power Divider," which is hereby incorporated by reference. See also Fusco, V. F. and S. B. D. O'Caireallain "Lumped Element Hybrid Networks for GaAs MMICs" Microwave Optical Tech. Lett., Vol. 2, January 1989 pp. 19-23; Parisi, S. J. "180° lumped element hybrid" Microwave Symposium Digest, 1989., IEEE MTT-S International Volume, Issue, 13-15 Jun. 1989 Page(s): 1243-1246 vol. 3 Digital Object Identifier 10.1109/MWSYM.1989.38951.

In addition, a combination of techniques may be used, such as a combination of transmission lines and lumped components techniques.

The length of the transmission lines 13 may be defined by the position of the radiating elements 7 and by the size of the hybrid circuits. Characteristic impedance of these lines 13 may be chosen according to the impedance for the hybrid circuits 14, 15. The function of the matching circuits 16 is to convert the complex impedance of the radiating elements 7 close to the characteristic impedance of the transmission lines 13 within the operational frequency band. These matching circuits may be produced with distributed and/or lumped components. See Wilfred N. Caron "Antenna Impedance Matching" The American Radio Relay League, 1989, pp. 4.1-4.11, 5.1-5.17.

Any person of ordinary skill in the relevant art of RF and microwave circuitry may design the feeding circuit 8. Design techniques are well established and published in multiple sources over the past few decades.

The side radiating elements 7 may be the conductive rods or wires with round or rectangular profile or the flat strips of conductive material positioned on the surface of the four non conductive substrates 9. The shape of the radiating element 7 is not limited by a straight line. It may be curved in the path from the feeding circuit 8 to its end. Width of the radiating elements 7 may be within about λ/400 to about λ/20. Substrates 9 are positioned to form the rigid box structure. Substrates 9 are generally thin, with a thickness from about λ/2000 to about λ/100, and are generally comprised of a rigid, low weight dielectric material with a relatively low effective dielectric constant (Dk) within a range of about 1.05 to about 7. The height H1 and the width W1 of the substrates 9 are defined by the length of the radiating elements 7 and by its tilt angle relative to the XY plane. The distance A1 between substrates 9 is defined by the shift of the radiating elements 7 from the boresight axis Z along the feeding circuit plane XY from the central point of this plane.

Function of the substrates 9 is to provide the support for the radiating elements 7 and the mechanical stability of the antenna. The length of the side radiating element 7 is adjusted to maintain the maximum radiation in the middle of the required operational frequency band. The flat radiating elements 7 positioned on the flat dielectric substrates 9 may be produced at low costs by using standard PCB manufacturing processes and with standard PCB materials, such as copper laminated FR4, G10, Rogers and/or other dielectric substrate materials developed for the electronics industry.

Figure 13:
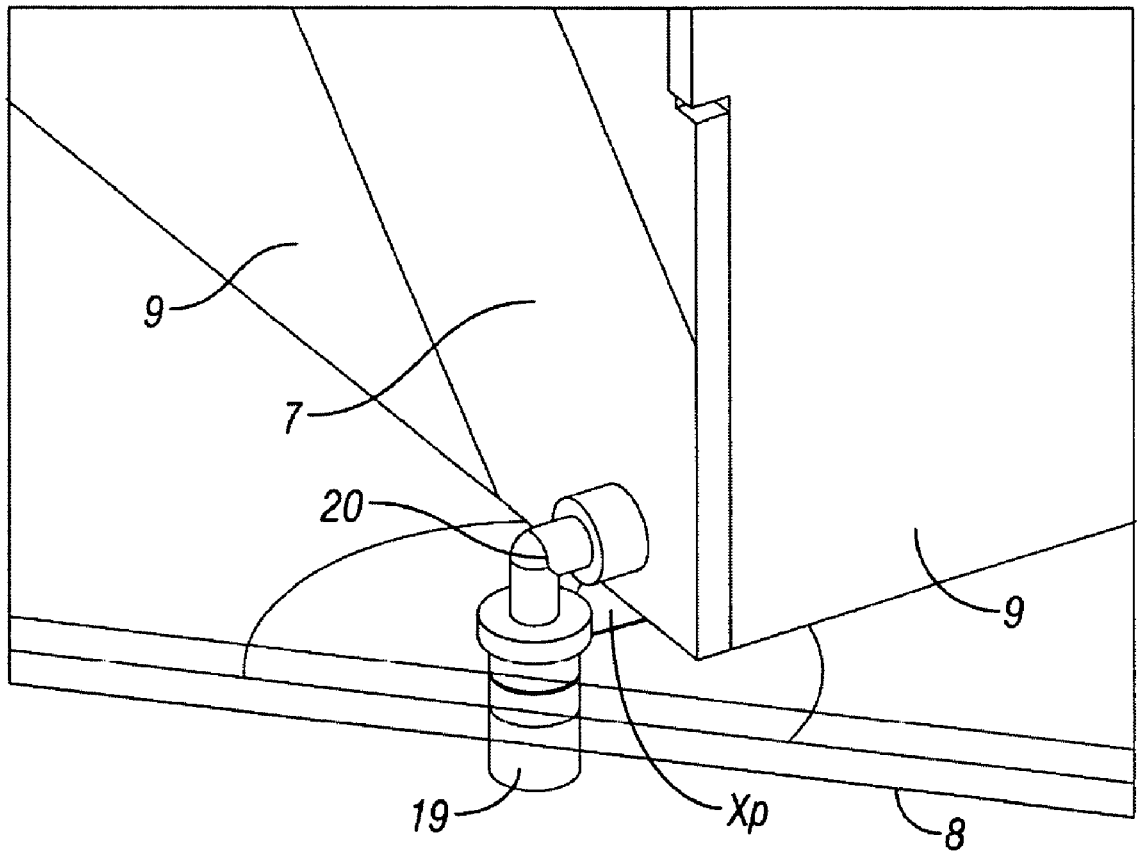
FIG. 13 is scaled up isometric view of the antenna shown in FIG. 9 according to one embodiment.

The interconnection between the feeding circuit 8 and radiating elements 7 may be accomplished as shown in FIG. 13. At the output ports Xp, Yp, Xn, Yn of the feeding circuit 8 there are connection sockets 19, which mate with the connection pins 20, installed on the radiating elements 7.

Figure 30:
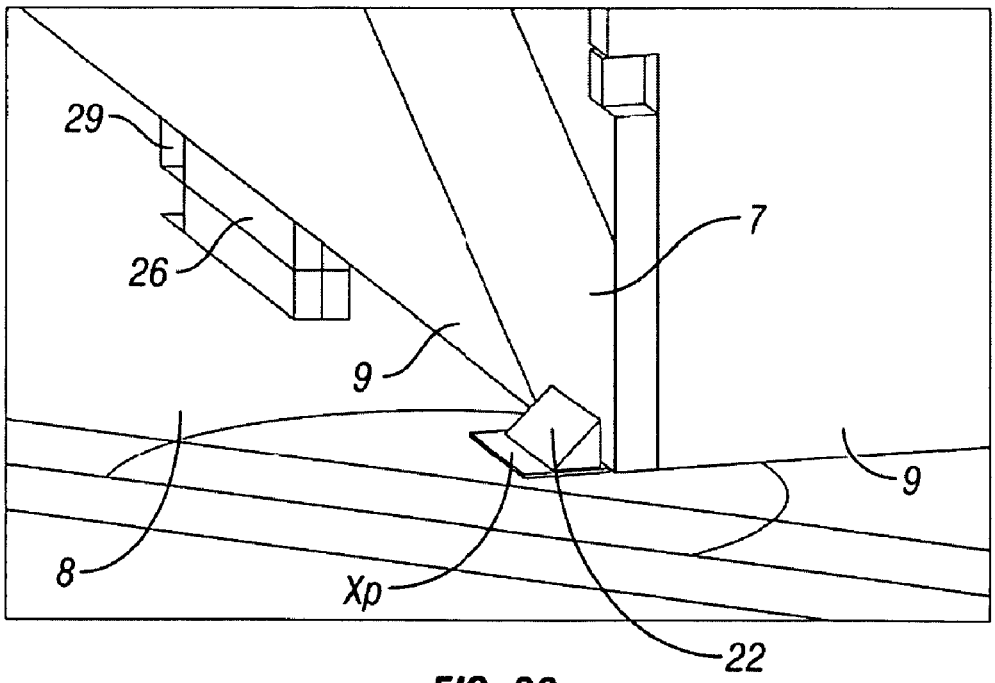
FIG. 30 is scaled up isometric view of the antenna shown in FIG. 25 showing an interconnection between a side radiating element and the feeding circuit according to one embodiment.

Another possible interconnection is show in FIG. 30 with the exposed conductive pads on the output ports Xp, Yp, Xn, Yn of the feeding circuit 8 and exposed conductive pads on the radiating elements 7 electrically bonded by solder material or conductive compound 22.

Figure 7A:
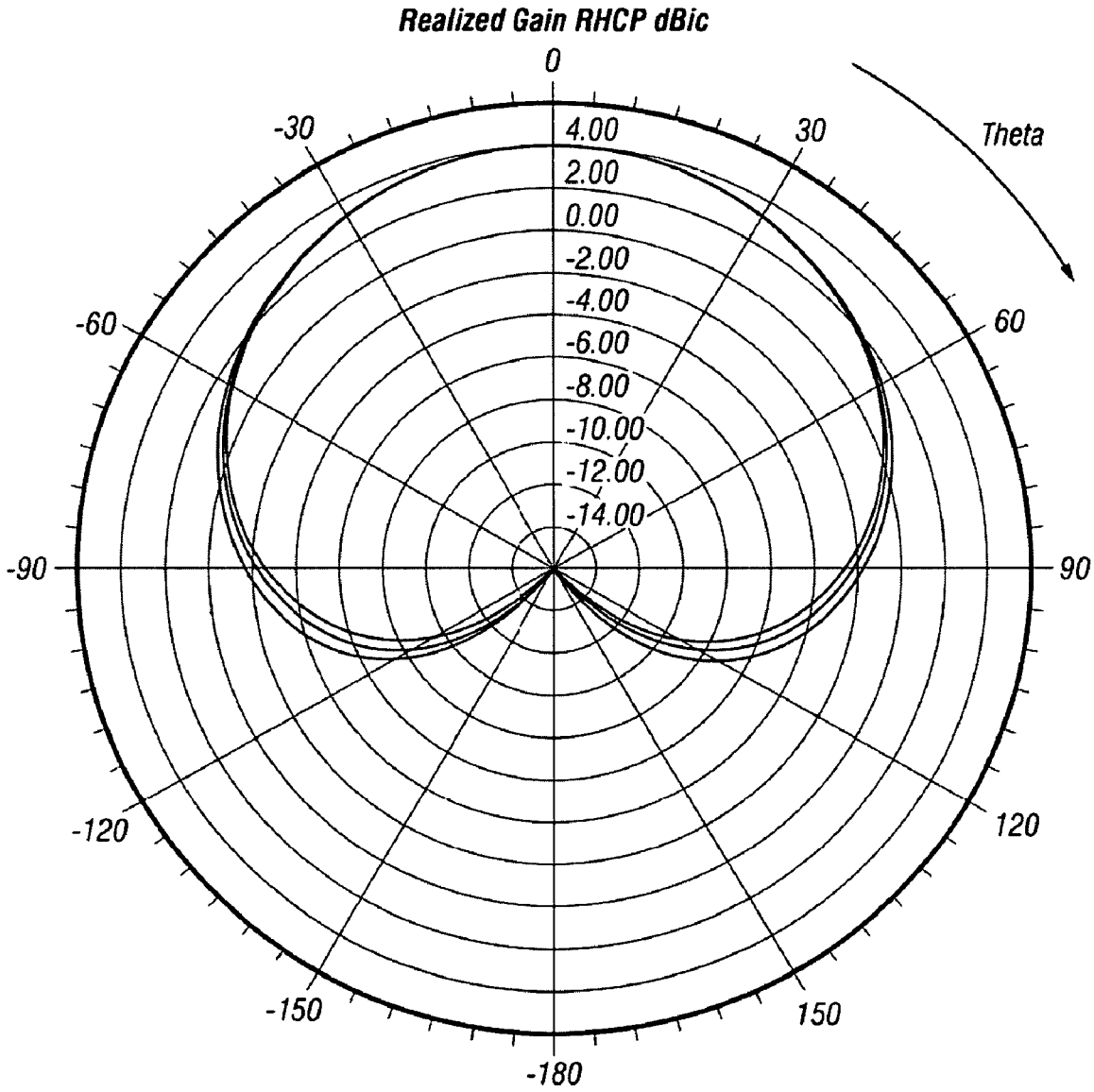
FIGS. 7A and 7B illustrate the radiation patterns of an antenna with four tilted radiating elements at the slices of Phi angles 0°, 45°, 90° for RHCP and Theta components of the radiated field.
Figure 7B:
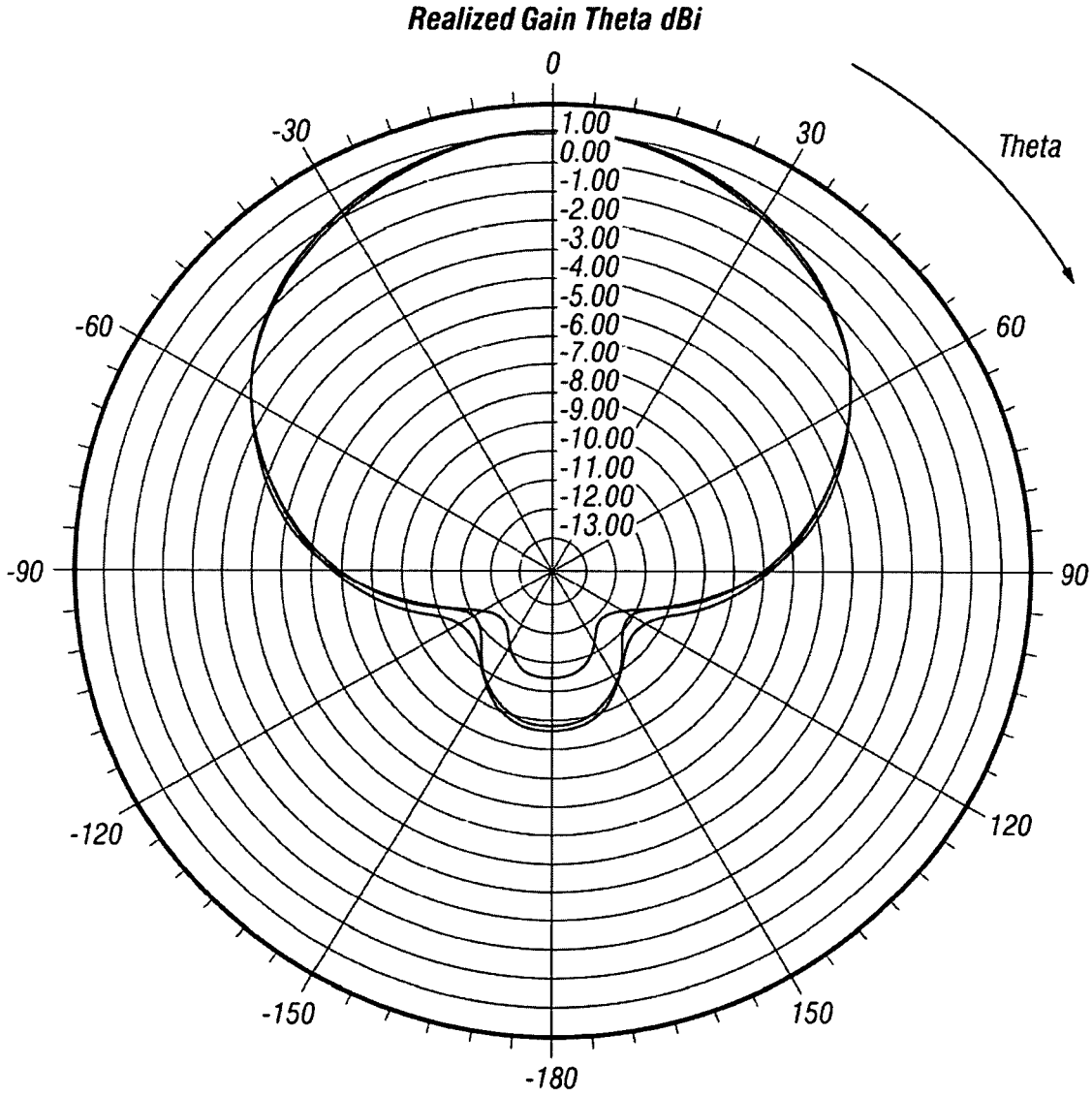

FIGS. 7A and 7B illustrate the radiation patterns of the antenna, according to one embodiment, as shown in FIG. 6. FIG. 7A shows the radiation pattern for a RHCP component at the slices of Φ angles 0°, 45°, 90°. FIG. 7B shows the radiation pattern for the θ component.

Figure 1:
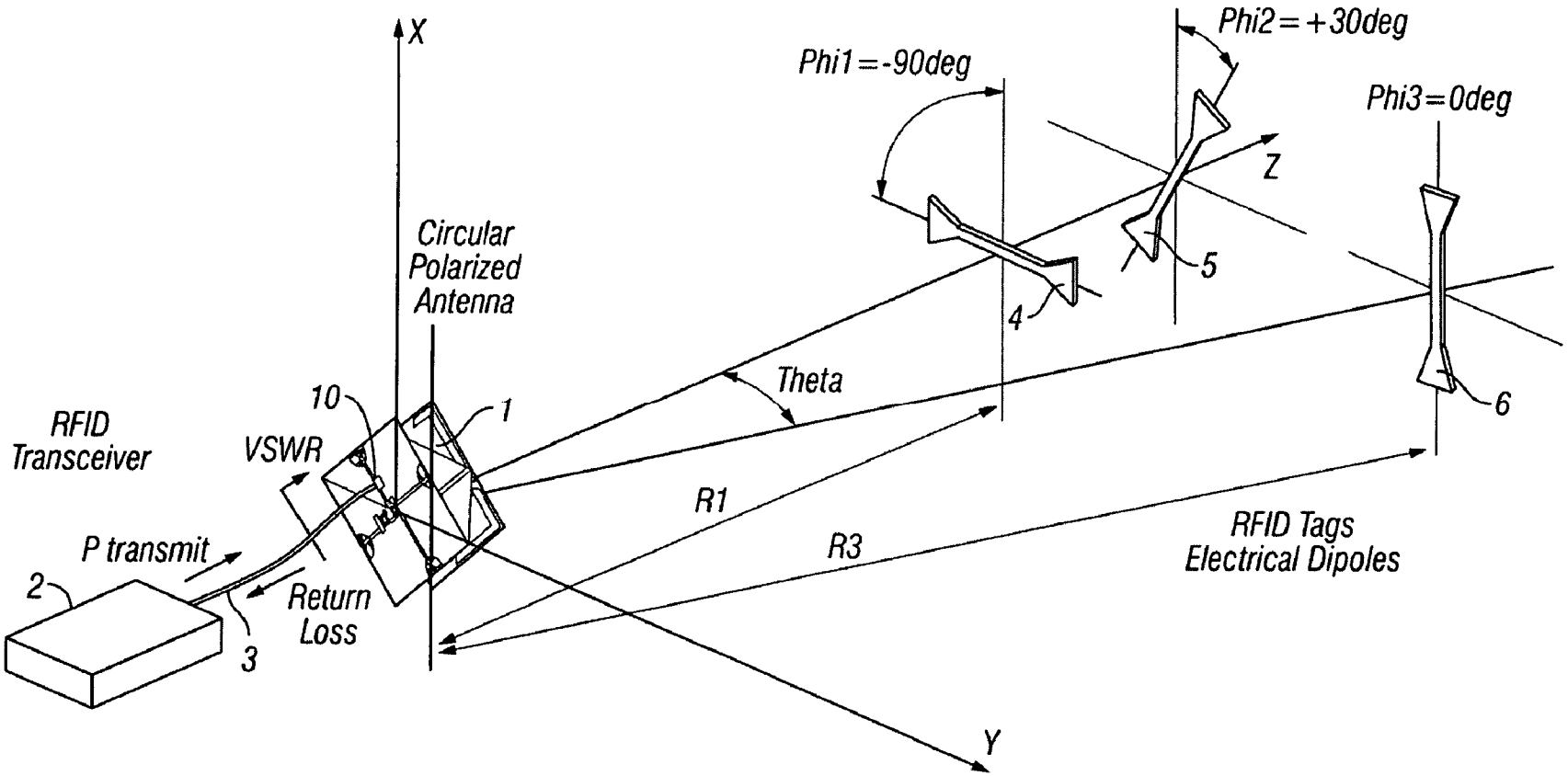
FIG. 1 (Prior Art)
FIG. 1 is a prior art RFID system.
Figure 2:
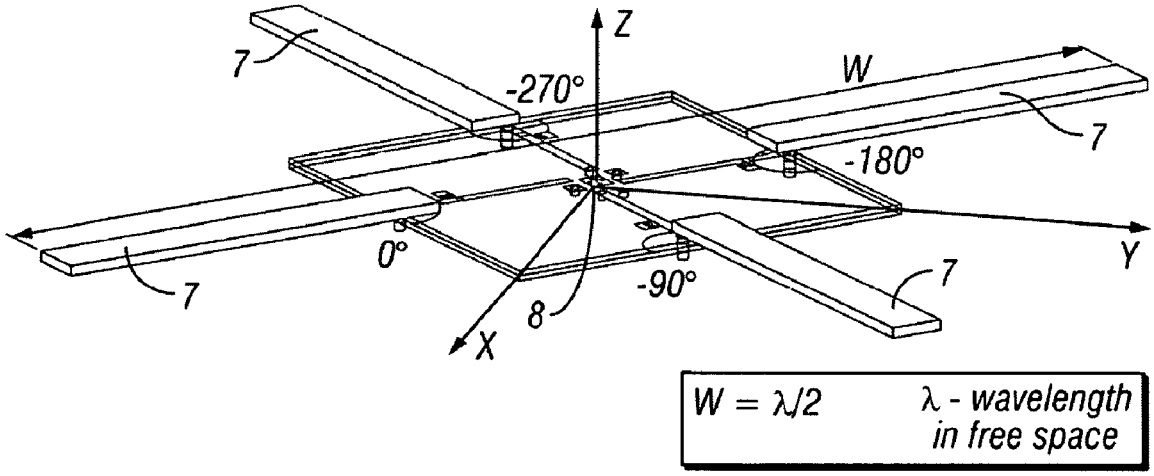
FIG. 2 (Prior Art)
FIG. 2 is a crossed dipole antenna or turnstile antenna according to the prior art.
Figure 3B:
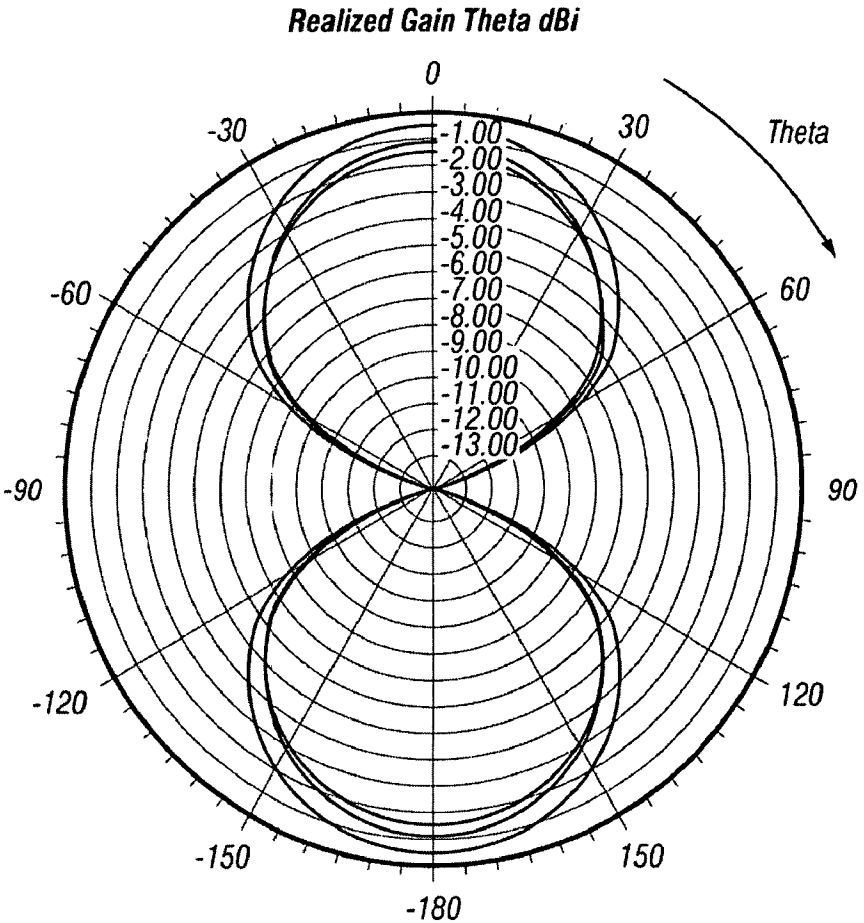
FIG. 3B (Prior Art)
FIGS. 3A and 3B illustrate the radiation patterns of a turnstile antenna at the slices of Phi angles 0°, 45°, 90° for RHCP and Theta components of the radiated field.
Figure 3A:
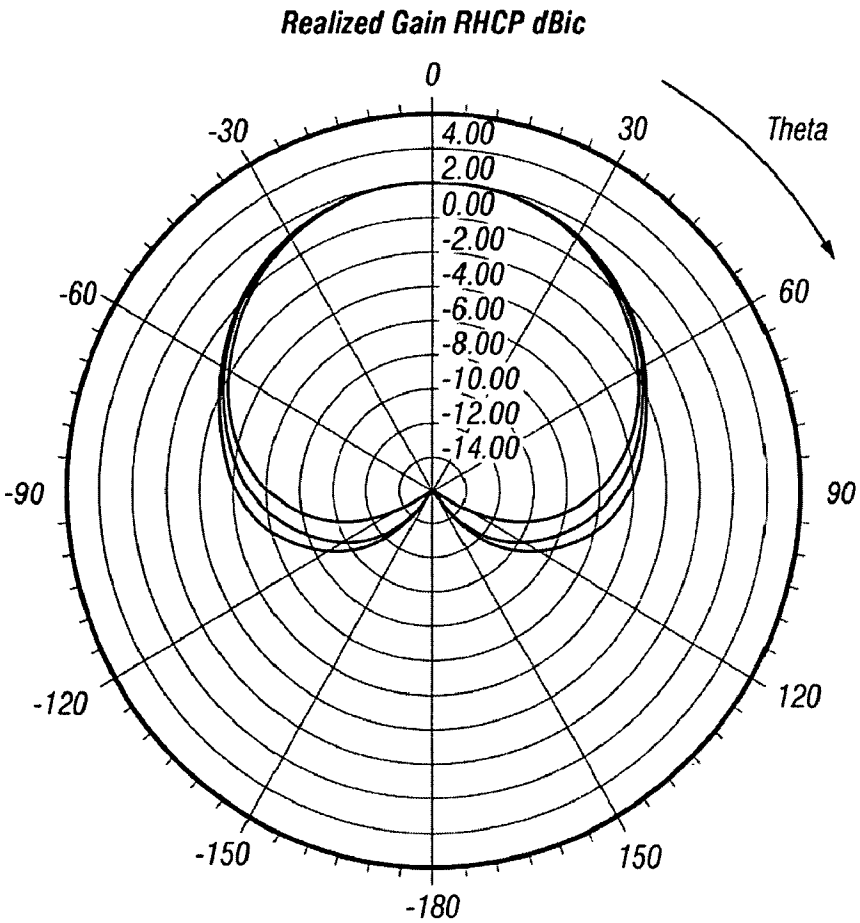
FIG. 3A (Prior Art)
Figure 4:
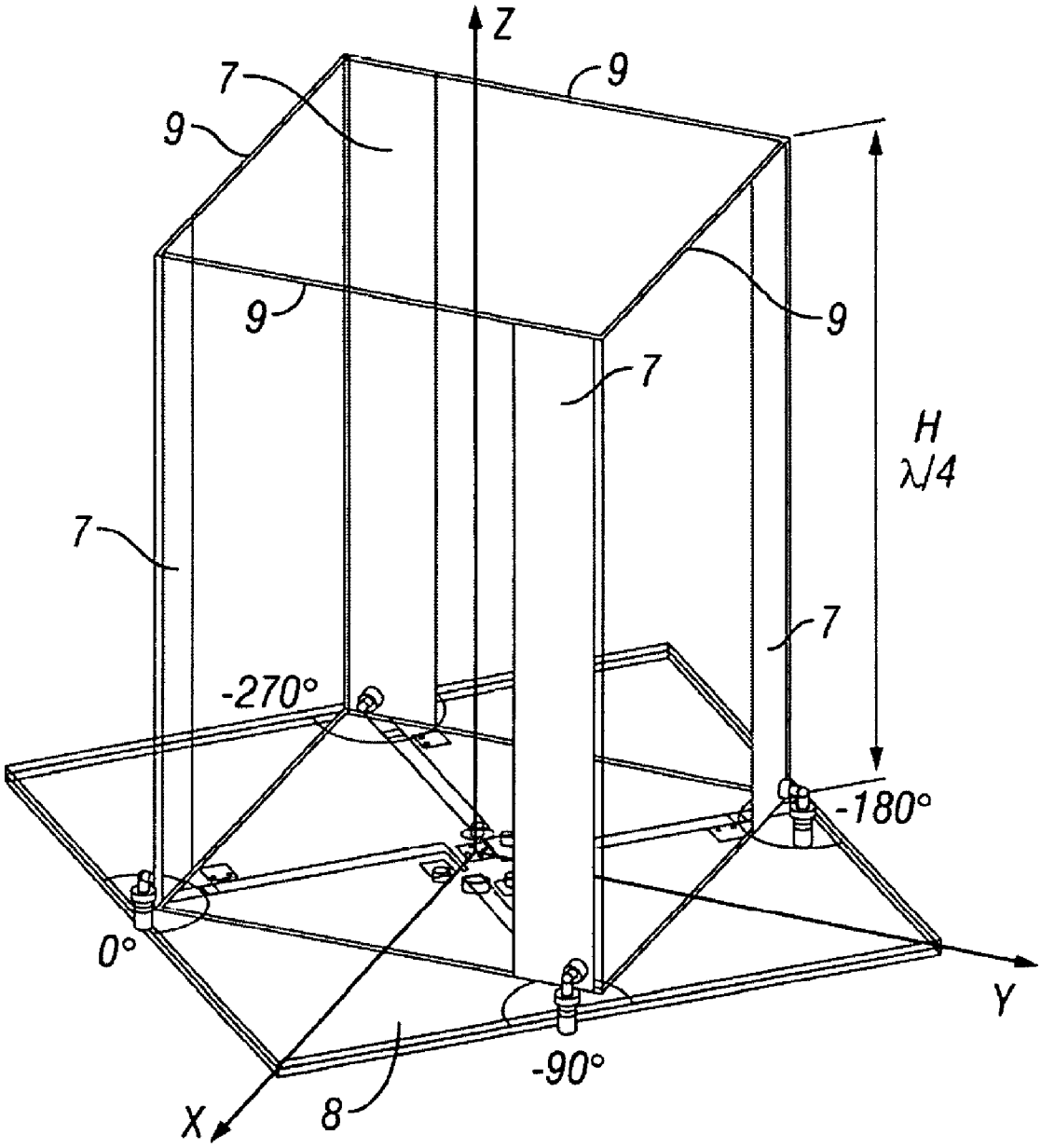
FIG. 4 (Prior Art)
FIG. 4 is a prior art antenna using folded dipoles.
Figure 5B:
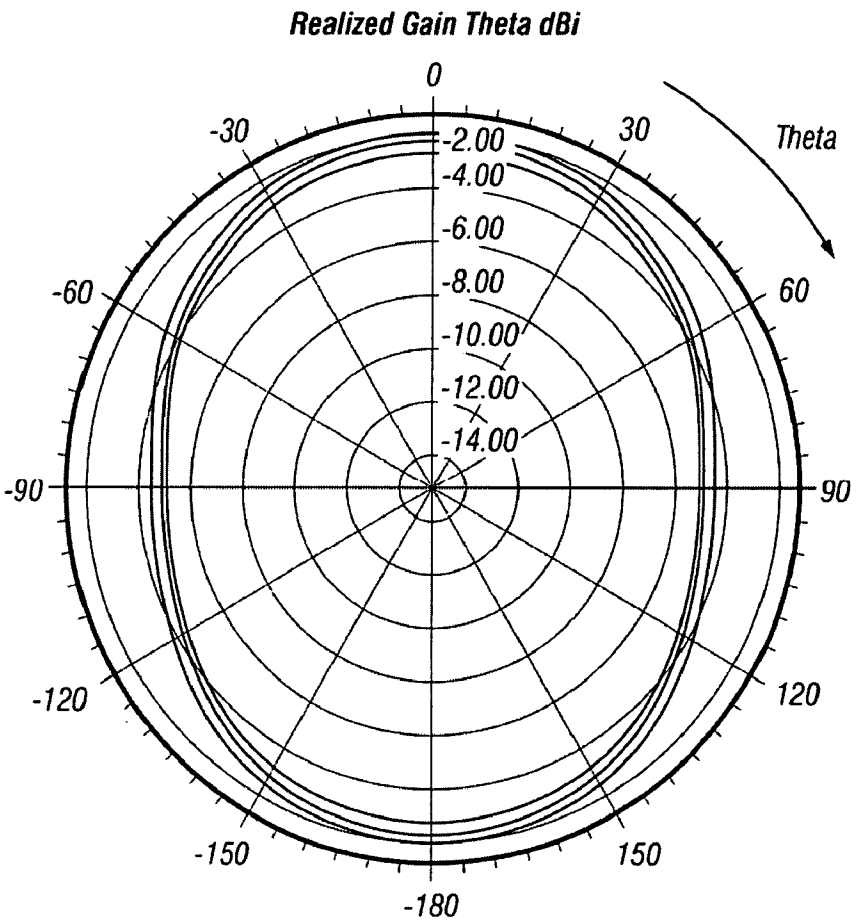
FIG. 5B (Prior Art)
FIGS. 5A and 5B illustrate the radiation patterns of the four monopole antenna system at the slices of Phi angles 0°, 45°, 90° for RHCP and Theta components of the radiated field.
Figure 5A:
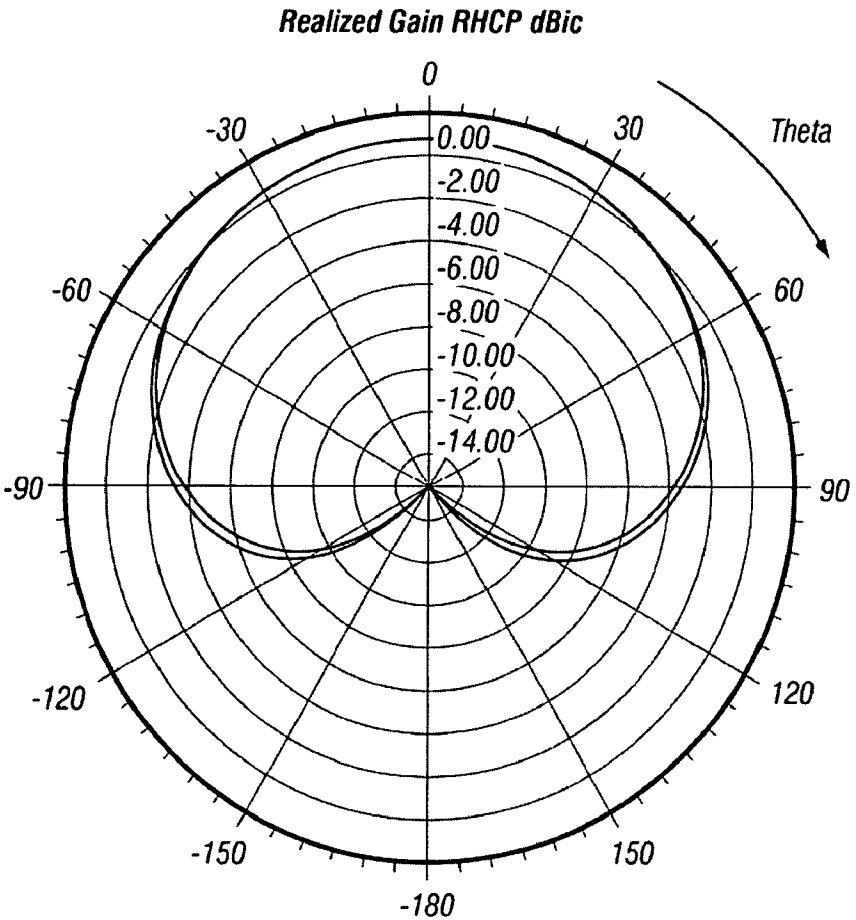
FIG. 5A (Prior Art)

When these patterns are compared to patterns from the prior art antennas, presented in FIGS. 3 and 5, especially for the θ component, it is clear that the antenna described herein provides significant concentration of energy in the preferred direction Z. The maximum realized gain of this antenna, according to some embodiments, is above +4 dBic for the RHCP component and above +1 dBi for the θ component. The circular polarization quality is also very good. The axial ratio is less than about 1 dB within the range of θ angles from boresight axis Z to more than +/−30°.

Figure 7C:
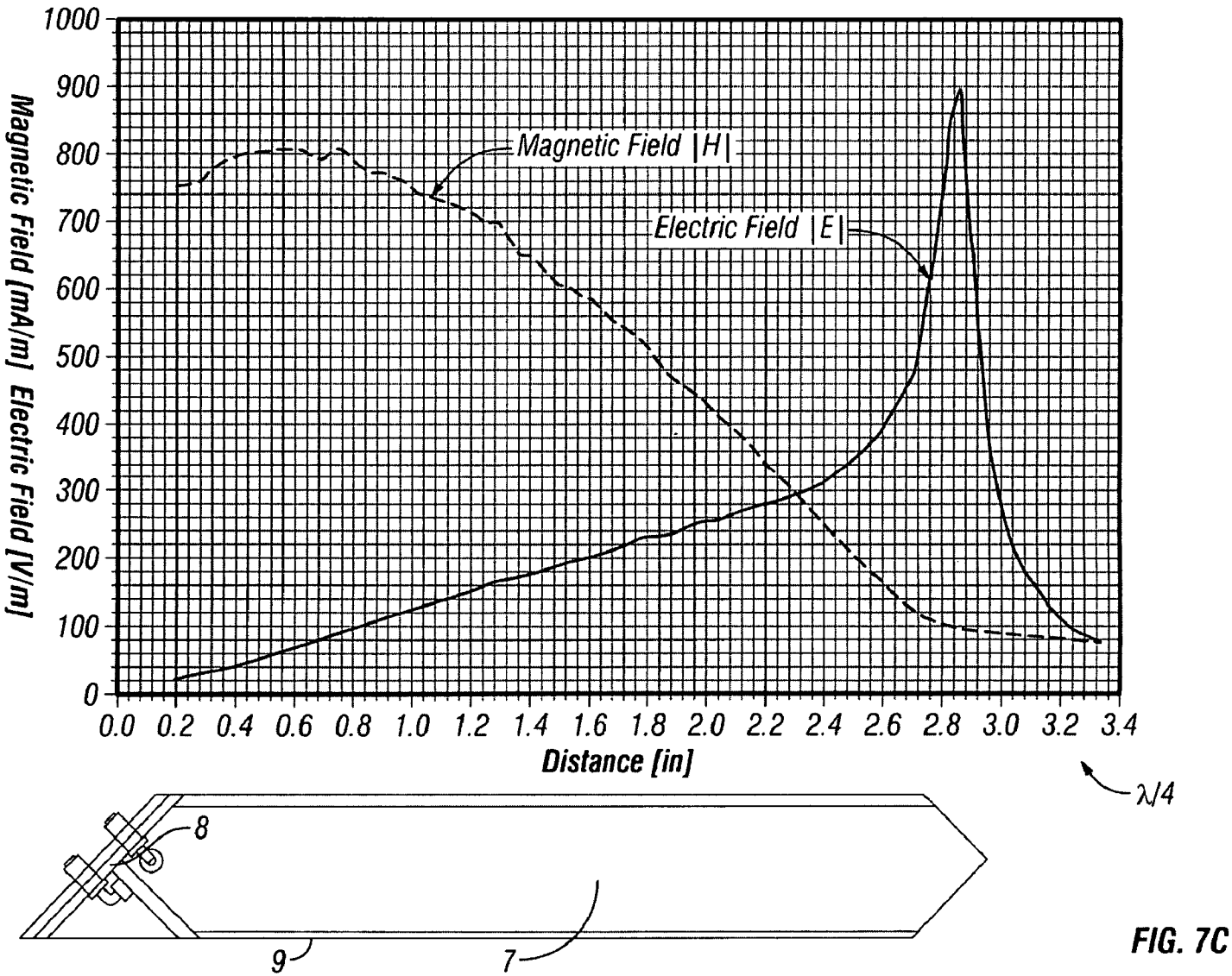
FIG. 7C presents a diagram of the magnitude distribution of the Near Magnetic and Electric Fields in the vicinity of the side radiating elements in the antenna presented in FIG. 6 according to one embodiment.

The tilt of the side radiating elements 7 repositions the near electric and near magnetic fields and concentrates the far electromagnetic radiation field in the preferable direction. FIG. 7C represents the analysis of the near magnetic and near electric field distribution along the radiating element 7, which reveals that the most of the magnetic field concentrates close to the end of the radiating elements 7 which is closer to the feeding circuit 8 and most of the electric field concentrates to the opposite end of radiating elements 7.

Figure 9:
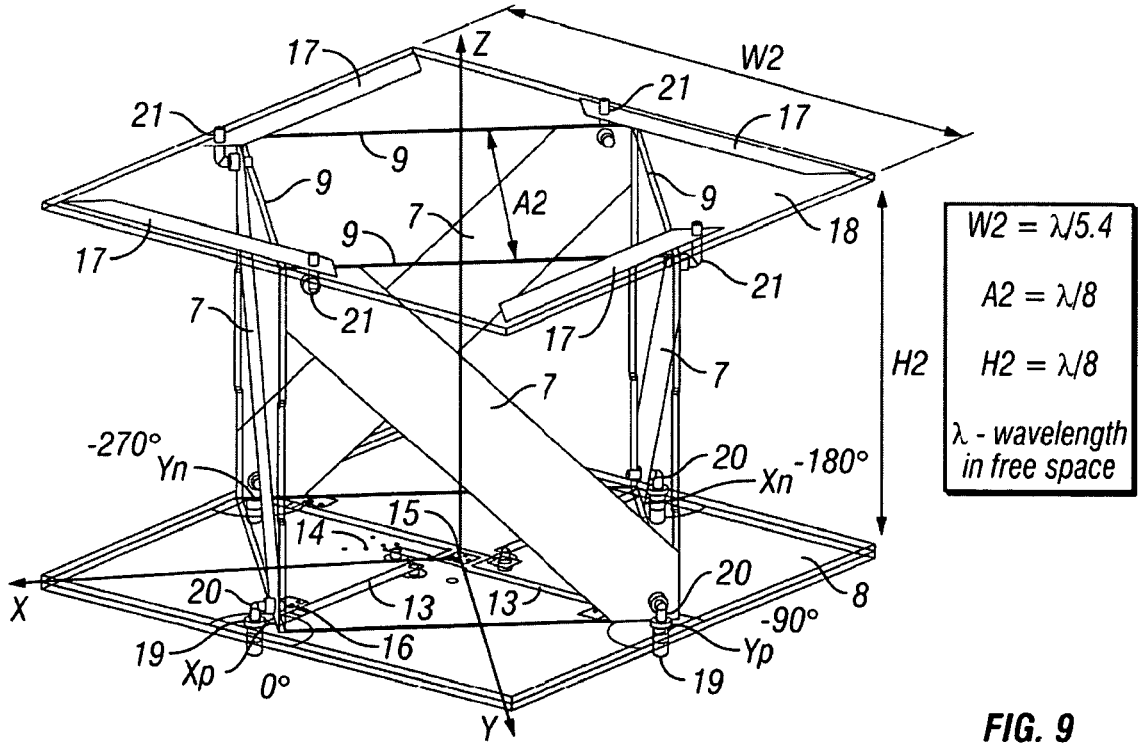
FIG. 9 is an isometric view of an antenna with four tilted side radiating elements according to one embodiment.

Shown in FIG. 9 is an embodiment which uses the local magnetic and electric field distribution feature presented in FIG. 7C to reduce the size of the antenna and to improve the radiation quality, e.g., increase the front to back ratio, reduce the back radiation, and increase the realized gain of the antenna.

To achieve these goals, each side radiating element 7 is divided into two pieces, at a point where the near magnetic field falls about 60% to about 80% from the maximum, preferably between about 60% and about 70% from the maximum, and the near electric field reaches about 20% to about 40% from its maximum, preferably between about 20% and about 30% from its maximum.

The pieces of the side radiating elements 7 with the maximum near magnetic field are positioned the same way as the side radiating elements 7 in the embodiment shown in FIG. 6.

Figure 10:
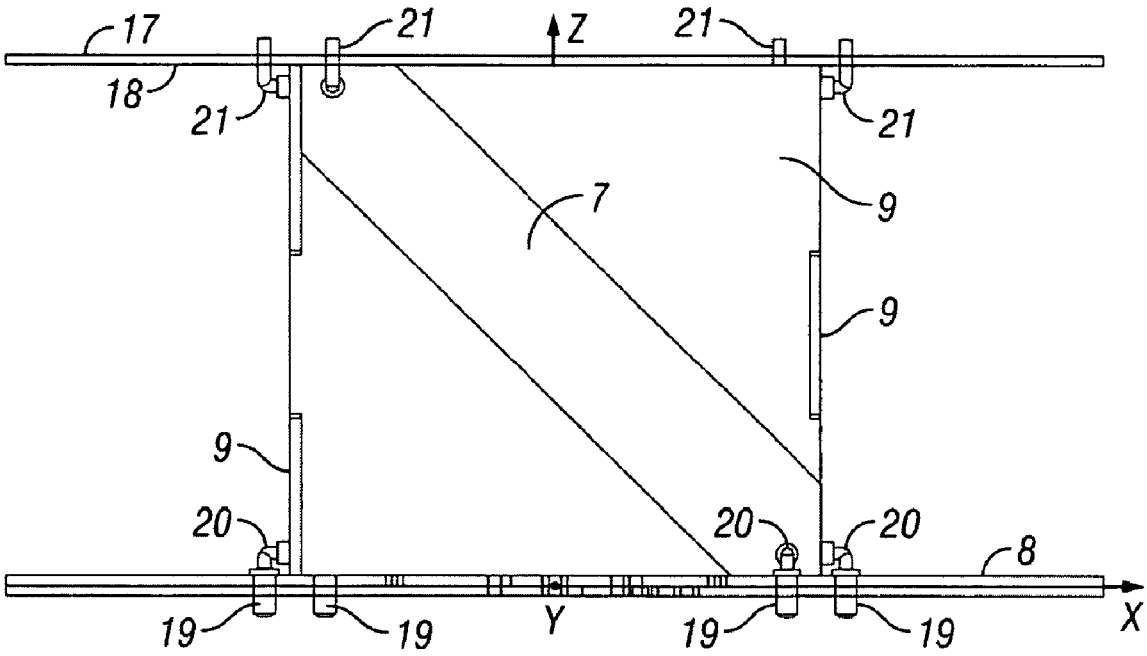
FIG. 10 is a side view of the antenna shown in FIG. 9 according to one embodiment.

The side radiating elements 7 may be conductive rods or wires with round or rectangular profiles or may be flat strips of conductive material positioned on the surface of the four non conductive substrates 9. Width of the side radiating elements 7 may be from about λ/400 to about λ/20. The length of the side radiating elements 7 may be about λ/5.7, +/−10%. The side substrates 9 are positioned to form the rigid box structure. The substrates are thin with thickness from about λ/2000 to about λ/100, and are comprised of a rigid, low weight dielectric material with a relatively low effective dielectric constant (Dk) of about 1.05 to about 7. The height H2 and the width of the side substrates 9 are defined by the length of the side radiating elements 7 and by its tilt angle relative to the XY plane and by the shift of radiating elements 7 from the boresight axis Z along the feeding circuit plane XY from the central point of this plane. The distance A2 between side substrates 9 is defined by the width of the side substrates 9. The shapes of side radiating element 7 and side substrate 9 are shown in FIG. 10, the side view of this embodiment. The shape of the side radiating element 7 is not limited by a straight line. It may be curved in the path from the feeding circuit 8 to its end.

The flat radiating elements 7 positioned on the flat dielectric substrates 9 may be produced at low costs by using standard PCB manufacturing processes.

Figure 12:
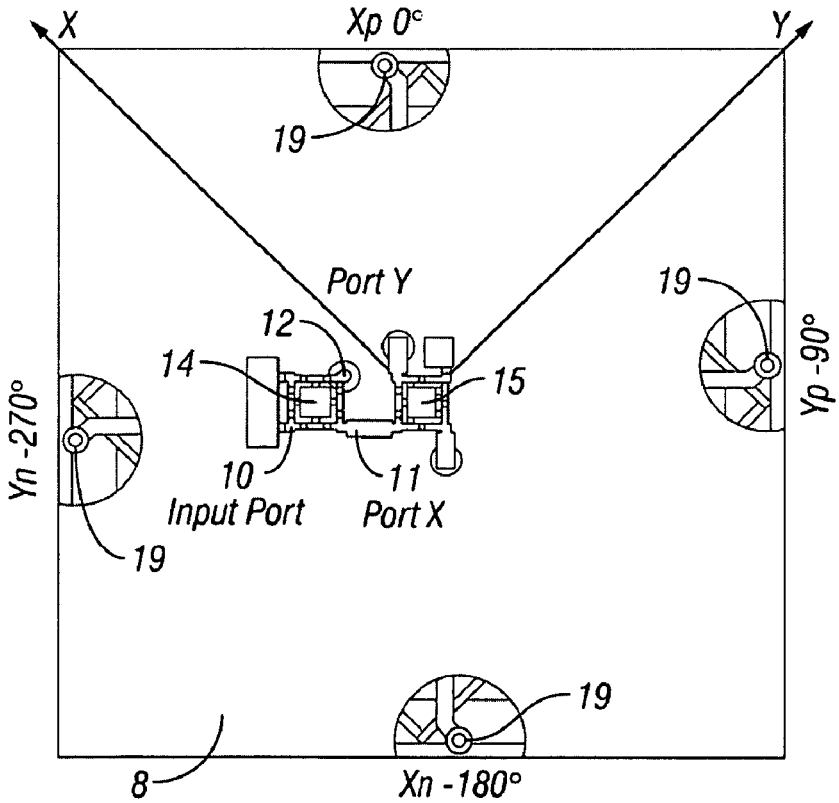
FIG. 12 is a bottom view of the antenna shown in FIG. 9 according to one embodiment.

The feeding circuit 8 is similar to that described in the previous embodiment. Components of the feeding circuit 8 in one possible embodiment are shown in FIG. 9—matching circuit 16, transmission lines 13, 180° hybrid circuits 15 on one or the top side of PCB and in FIG. 12—90° hybrid circuits 14, 180° hybrid circuits 15, Port X 11, Port Y 12 and input Port 10 on the opposite or bottom side of PCB.

The interconnection between the feeding circuit 8 and side radiating elements 7 may be accomplished as shown in FIG. 13. Of course, any other connection method may be used, and this example is not meant to be limiting in any way. At the output ports Xp, Yp, Xn, Yn of the feeding circuit 8 there may be connection sockets 19, which mate with the connection pins 20, installed on the radiating elements 7.

Figure 11:
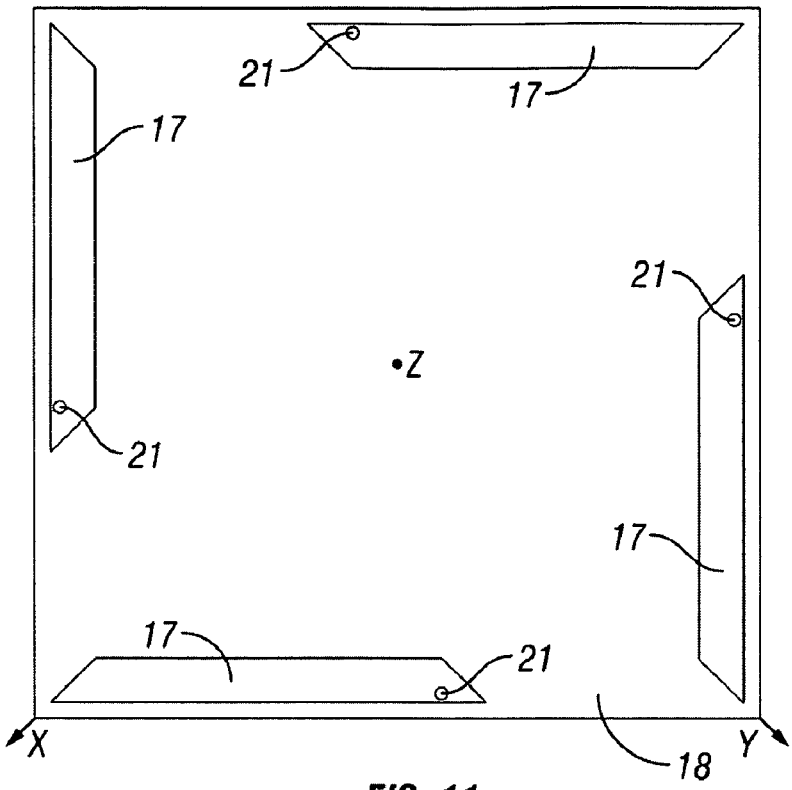
FIG. 11 is a top view of the antenna shown in FIG. 9 according to one embodiment.

Now referring to FIG. 11, the antenna may include a plurality of top radiating elements 17. Each top radiating element 17 is electrically coupled to an associated one of the side radiating elements 7, each top radiating element 17 extending for at least a portion of a length thereof in a direction that is not collinear with the longitudinal axis of the associated side radiating element 7.

The top radiating elements 17 with the maximum near electric field are tilted more in the direction to the feeding circuit plane XY and are rotated toward the boresight axis Z. This redistributes the near electric field relative to the near magnetic field and better concentrates the propagation in the positive boresight direction Z.

The top radiating elements 17 may be conductive rods and/or wires with a shape selected from a group consisting of straight, serpentine, rectangular, round (including oval), triangular, and combinations thereof.

In a more preferable embodiment, the top radiating elements 17 may be strips of conductive material positioned on the surface of a top nonconductive substrate 18. The shapes of the top radiating elements 17 and the substrate 18 are shown in FIG. 11, the top view of this embodiment. The shape of the radiating elements 17 is not limited by a straight line. It may be curved in a path from the connection point with radiating elements 7 to its end.

Width of the top radiating elements 17 may be from about $\lambda/400$ to about $\lambda/20$ and may vary along its length. The length of the top radiating elements 17 in some embodiments is about $\lambda/2.7$. This length may vary in dependence to the length of the side radiating elements 7 and may be adjusted to maintain the maximum radiation in the middle of the operational frequency band.

The interconnection between the top radiating elements 17 and side radiating elements 7 may be accomplished as shown in FIGS. 9 and 10. The connection pins 21 with the "L" shape are installed on the end of the side radiating elements 7. The other end of the connection pins 21 are passed through hole at the top radiating elements 17 and soldered on top of it.

The top substrates 18 are thin, with thickness from about $\lambda/2000$ to about $\lambda/100$, and are comprised of a rigid, low weight dielectric material with a relatively low effective dielectric constant (Dk) from about 1.05 to about 7. It may be the same substrate as is used for the side radiating elements 9, or may be a different substrate. The function of the top substrate 18 is to provide support for the top four additional radiating elements 17 and to increase the mechanical stability of the antenna.

In more embodiments, a width of each of the side radiating elements 7 in a direction perpendicular to the longitudinal axis thereof may be between about $\lambda/400$ and about $\lambda/20$, wherein the top radiating elements 17 are elongated, and a width of each of the top radiating elements 17 in a direction perpendicular to a longitudinal axis thereof is between about $\lambda/400$ and about $\lambda/20$. In some additional embodiments, the top radiating element 17 and the side radiating element 7 may have the same width.

In some embodiments, at least one of the side radiating elements 7 and the top radiating elements 17 are not coupled to a supporting substrate along an entire length thereof. For example, the top radiating element 17 may not have a substrate with which to support it, the substrate may have an exposed portion where the top radiating element 17 passes through, etc.

Still referring to FIG. 11, according to some embodiments, the top and associated side radiating element (7 & 17) together may form a radiating element, wherein a point of coupling of the top and side radiating elements (7 & 17) is at a point along the radiating element where a near magnetic field of the radiating element is between about 20% and about 30%, (where about X % means X % ±5%), alternatively between about 30% and about 40%, alternatively between about 40% and about 50%, alternatively between about 60% and about 70%, below a maximum near magnetic field of the radiating element. Of course, any range may be used, including between about 10% and about 90% below a maximum near magnetic field of the radiating element.

In more embodiments, the side radiating elements 7 may each have a protrusion extending at least partially through a supporting substrate of the top radiating elements 17, where the top radiating elements 17 are each coupled to the protrusion of the associated side radiating element 7. This connection may be similar or different from that shown in FIG. 13, an embodiment of a connection between the feeding circuit and a side radiating element 7.

Figure 21:
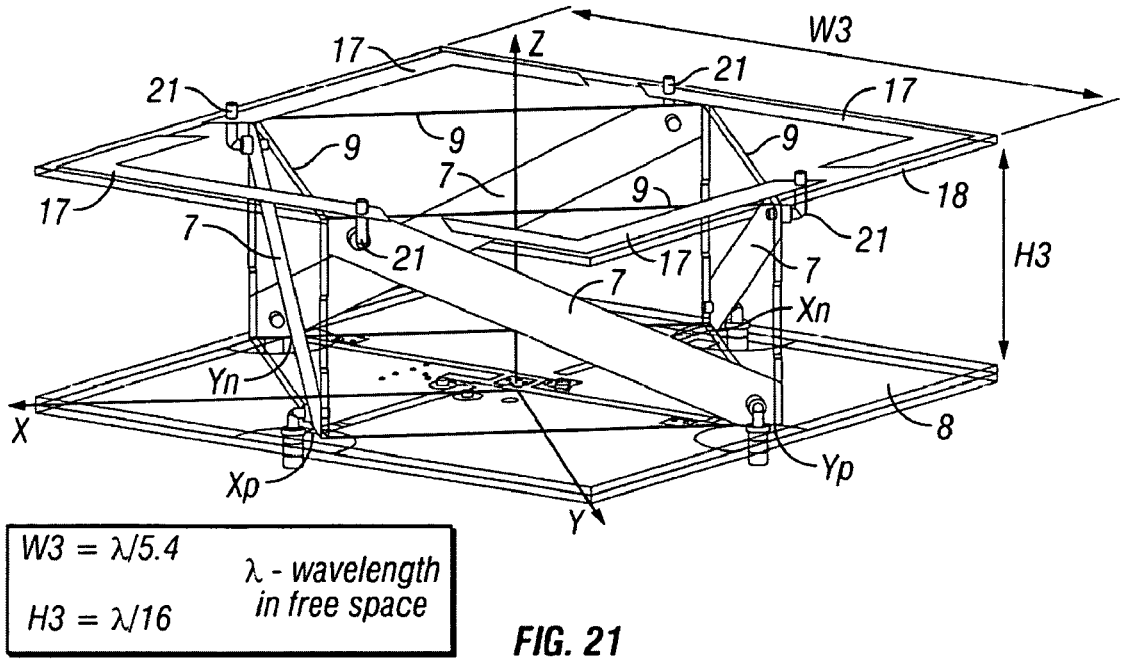
FIG. 21 is an isometric view of an antenna with four tilted side radiating elements according to one embodiment.

In some further approaches, as shown in FIG. 21, a distance H3 between the feeding circuit XY plane and a plane extending through couplings of the side radiating elements and the top radiating elements is between about $\lambda/6$ and about $\lambda/32$, preferably between about $\lambda/8$ and about $\lambda/24$, where $\lambda$ is a free space wavelength of radiation at a middle frequency of an operational frequency band of the antenna.

Figure 14A:
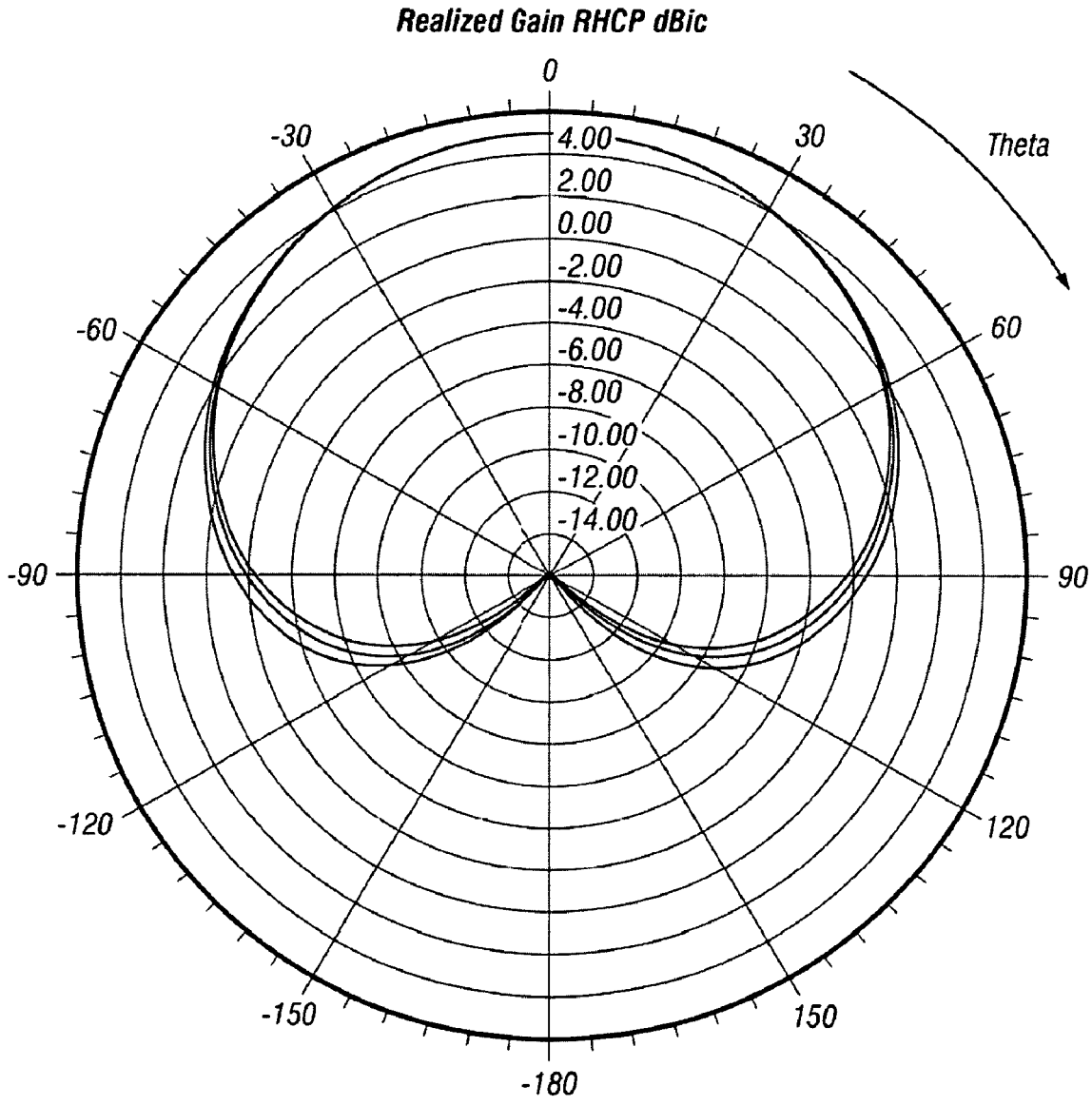
FIGS. 14A and 14B illustrate the radiation patterns of the antenna shown in FIG. 9 at the slices of Phi angles 0°, 45°, 90° for RHCP and Theta components of the radiated field.
Figure 14B:
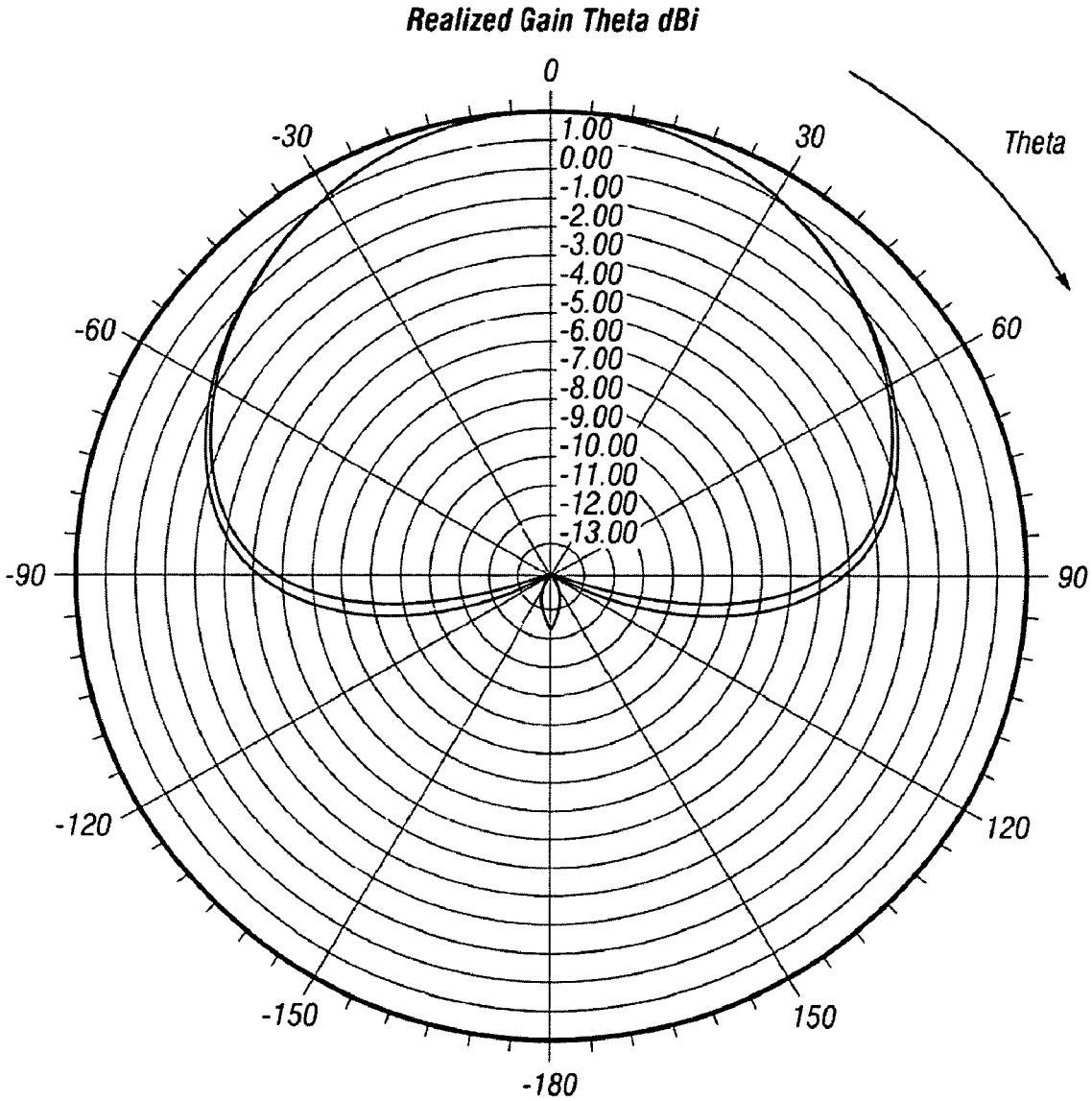

FIGS. 14A and 14B illustrate the radiation patterns of the antenna, according to one embodiment, which is shown in FIG. 9. FIG. 14A is the radiation pattern for the RHCP component at the slices of $\Phi$ angles 0°, 45°, 90°. FIG. 14B is the radiation pattern for the $\theta$ component.

By comparing these patterns with the patterns for the previous embodiment presented in FIGS. 7A-B, especially for the $\theta$ component, it is clear that this embodiment of the antenna provides improvement of concentration of energy in the preferred direction Z. The maximum realized gain is above about +4.8 dBic for the RHCP component and above about +1.8 dBi for the $\theta$ component. The back radiation is reduced from about −8.5 dBi to about −12.5 dBi and the front to back ratio is increased from about +9.5 dB to about +14.3 dB.

Figure 15:
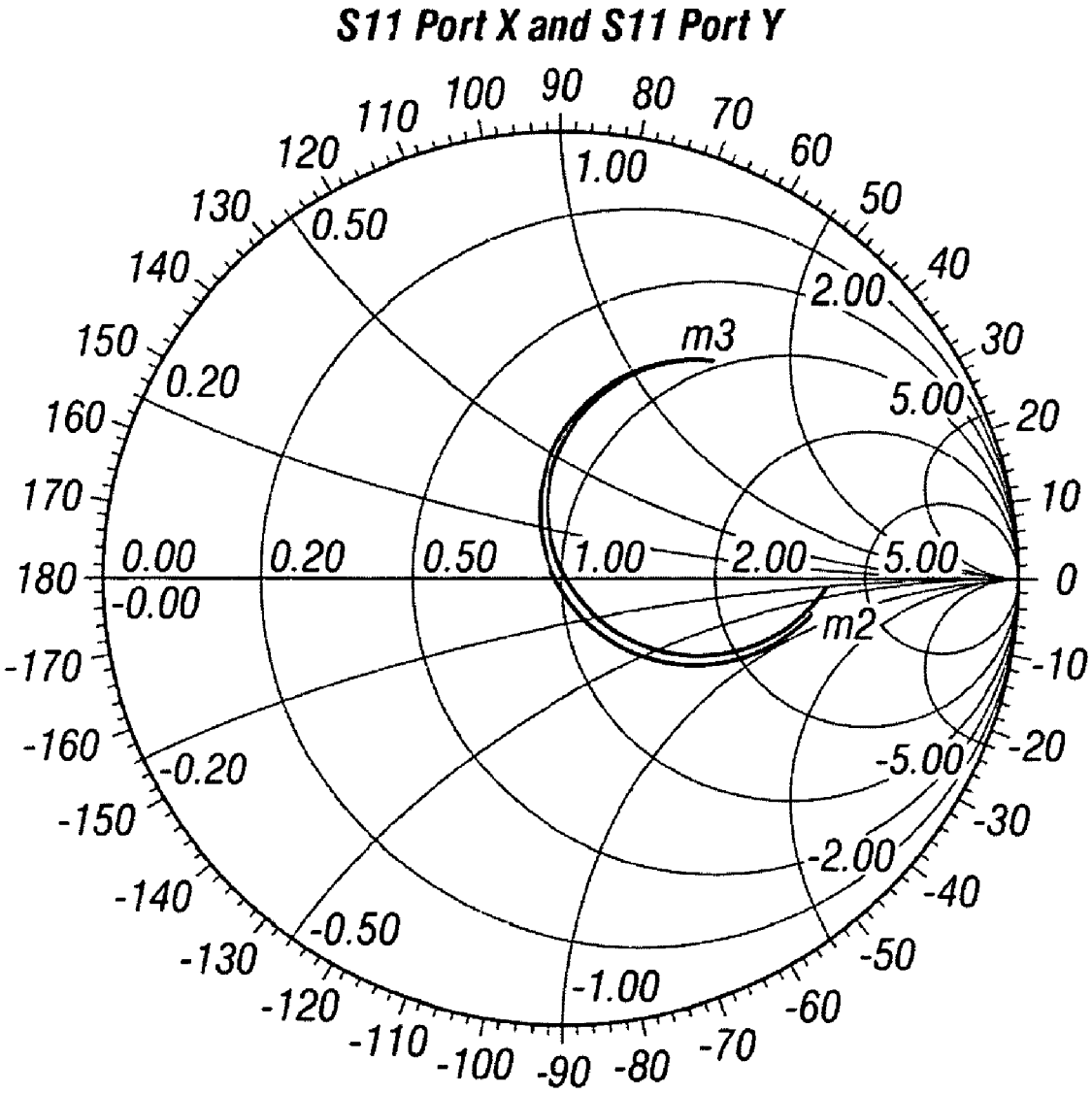
FIG. 15 presents the S11 parameters of the antenna shown in FIG. 9 at the intermediate Port X and Port Y of the feeding circuit, shown in FIG. 8.
Figure 16:
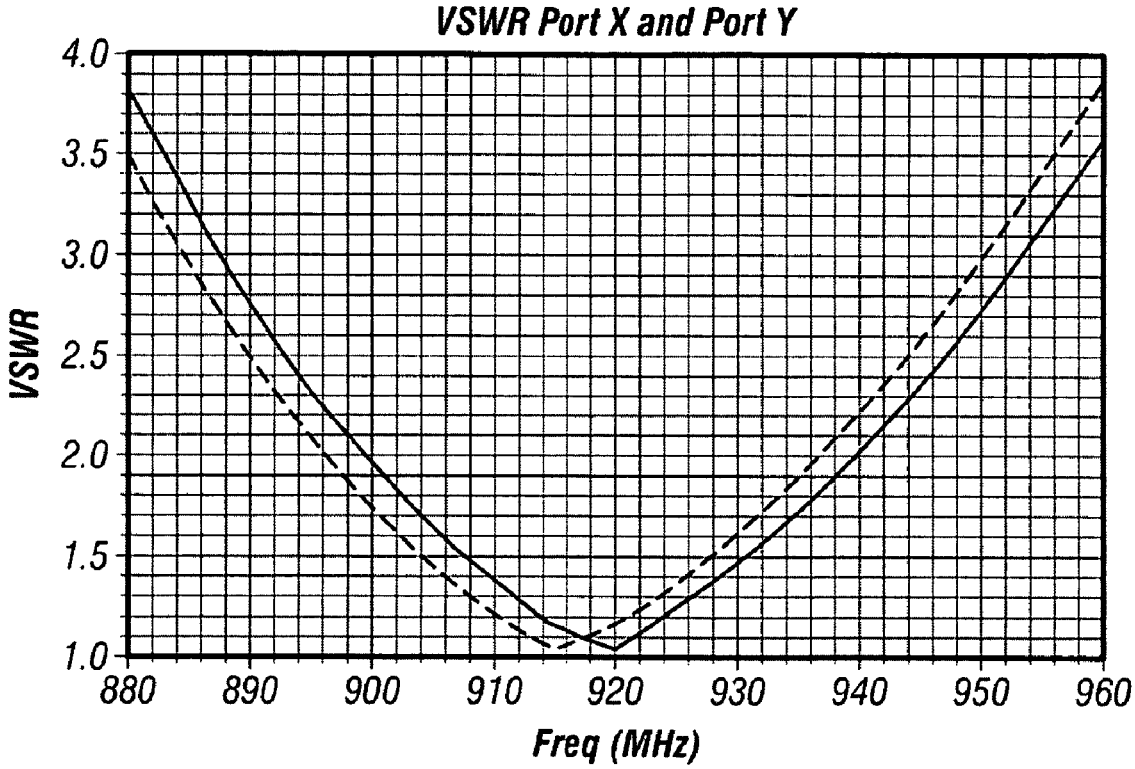
FIG. 16 presents the VSWR parameters of the antenna shown in FIG. 9 at the intermediate Port X and Port Y of the feeding circuit, shown in FIG. 8.

FIGS. 15 and 16 illustrate the behavior of the impedance and the VSWR at the intermediate Port X 11 and Port Y 12 of the feeding circuit 8, according to one embodiment, realized for the 900-930 MHz frequency band. The VSWR remains below 2.0 within +/−2.1% from the central frequency.

Figure 17:
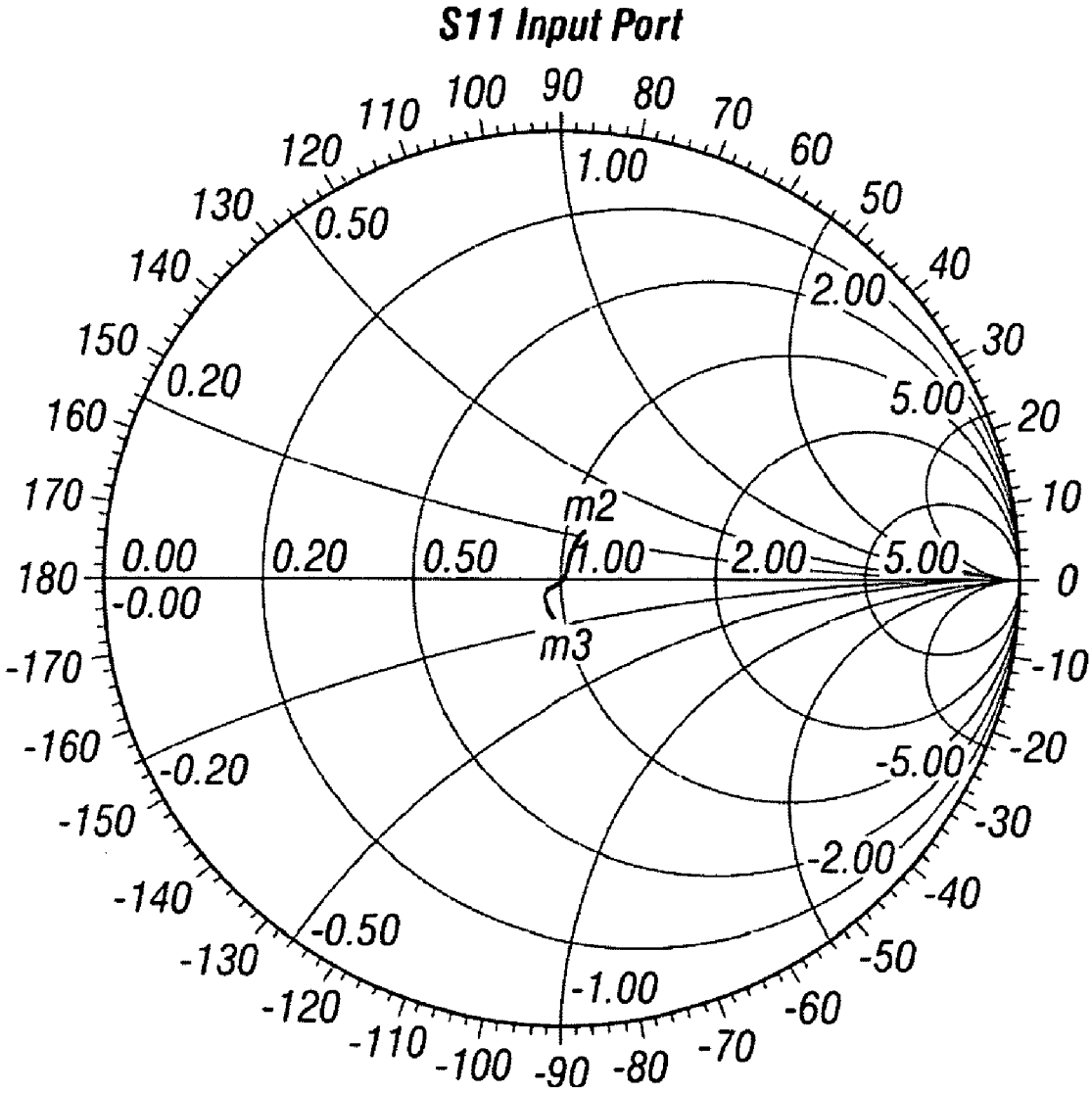
FIG. 17 presents the S11 parameters of the antenna shown in FIG. 9 at the input Port of the feeding circuit, shown in FIG. 8.
Figure 18:
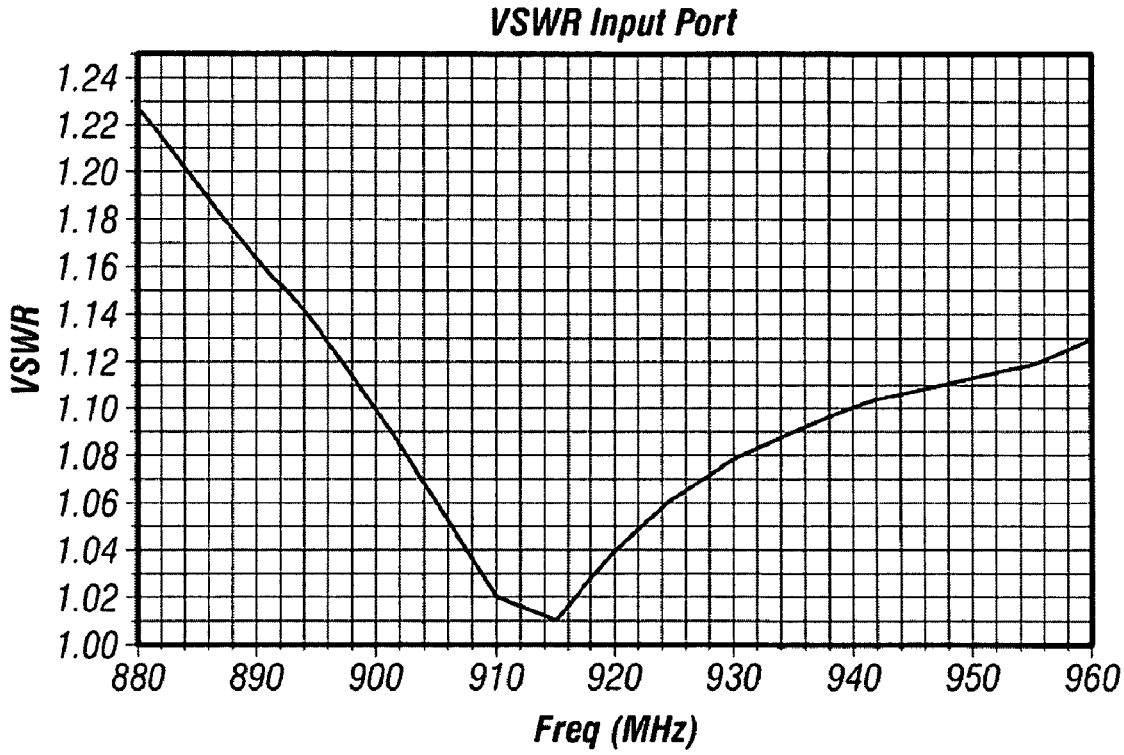
FIG. 18 presents the VSWR parameters of the antenna shown in FIG. 9 at the input Port of the feeding circuit, shown in FIG. 8.

FIGS. 17 and 18 illustrate the behavior of the impedance and the VSWR at the input port 10 of the feeding circuit 8, according to one embodiment. The VSWR remains below 1.2 within more than about +/−4.4% from the central frequency.

Figure 19:
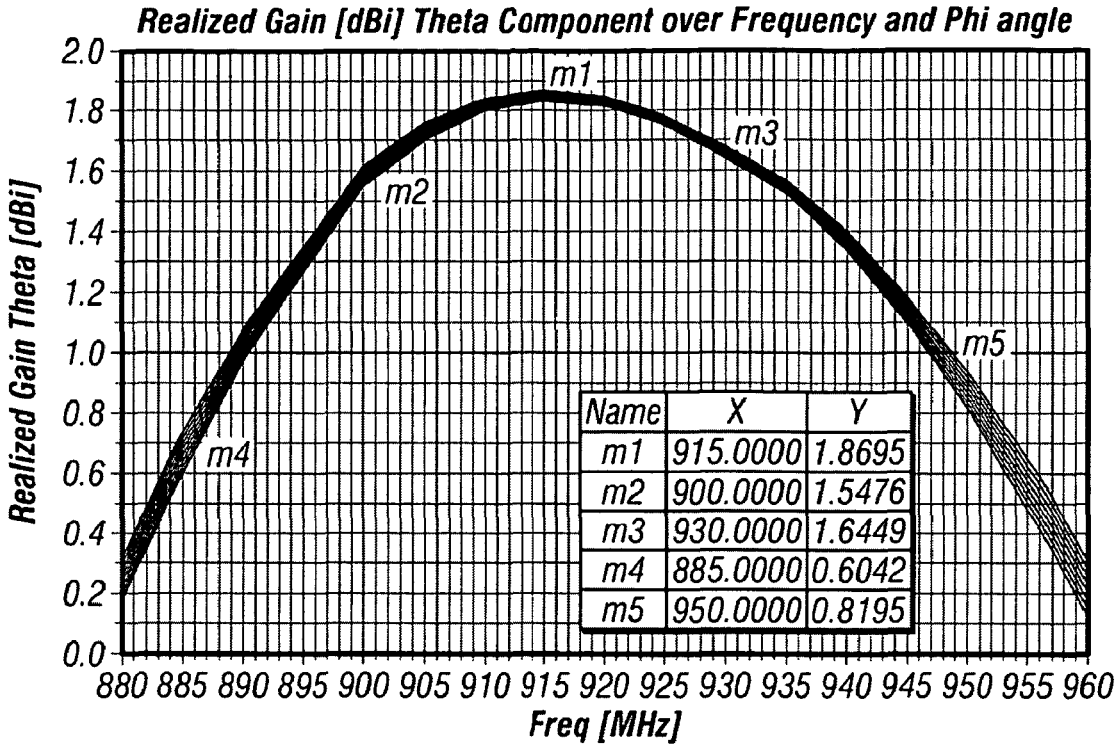
FIG. 19 shows the realized gain for the Theta component of radiation from the antenna shown in FIG. 9.

FIG. 19 represents the realized gain for the θ component of radiation in boresight direction Z over the frequency band and at the several slices of Φ angle from 0° to 180°. Analysis of this diagram shows that the proposed embodiment provides a radiation bandwidth of more than +/−3.4% from the central frequency at the level −1.0 dB from the maximum, and more than +/−4.4% from the central frequency at the level −1.6 dB from the maximum. This is significantly wider than bandwidth provided by prior art helical antennas.

Figure 20:
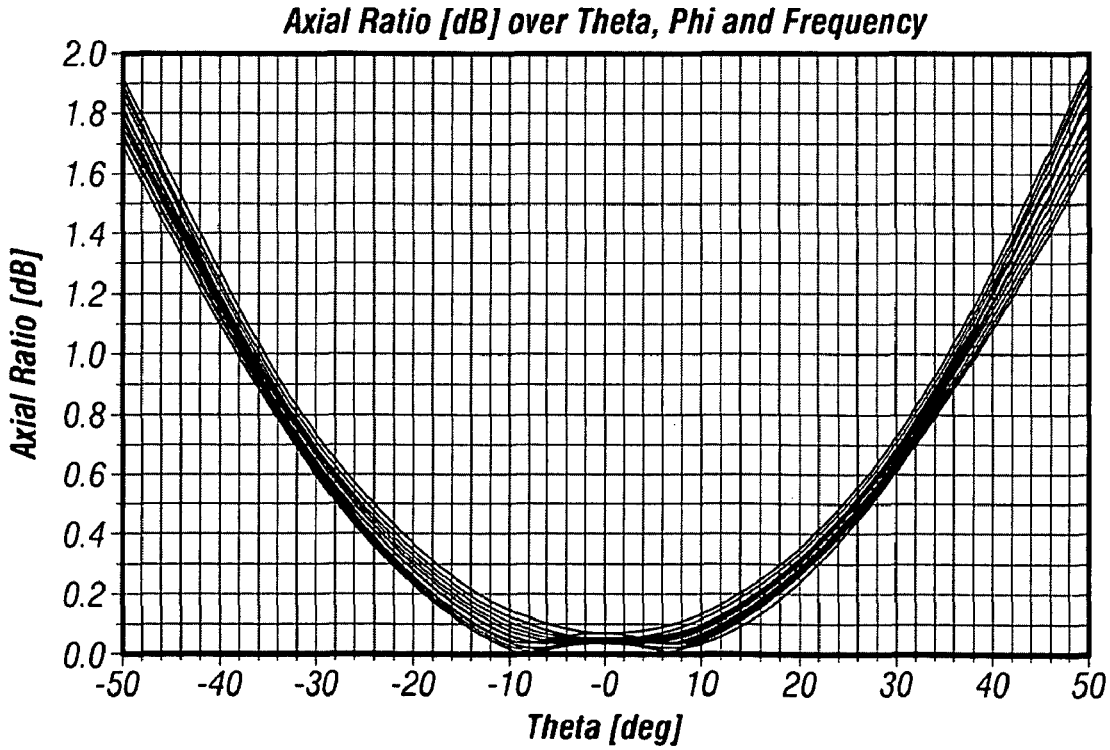
FIG. 20 shows the axial ratio of radiation from the antenna shown in FIG. 9.

In addition, the axial ration, as shown in FIG. 20, according to one embodiment, has a wider beam width. The axial ration at the level 1.0 dB is within about +/−35° from the boresight axis Z.

According to another embodiment of an antenna, as shown in FIG. 21, further reduction of the antenna size is possible. The radiating elements 7 and 17 are divided similar to the previous embodiment; however, the point of division is shifted. The point of division is where the near magnetic field falls about 40% to about 60% from its maximum, preferably about 40% to about 50% from its maximum. The side radiating elements 7 become shorter and are tilted more toward the feeding circuit plane XY. This reduces the side dielectric substrates 9 and the overall thickness H3 of the antenna. The thickness H13 is about λ/16 and may vary within about +/−50% or more.

Figure 22:
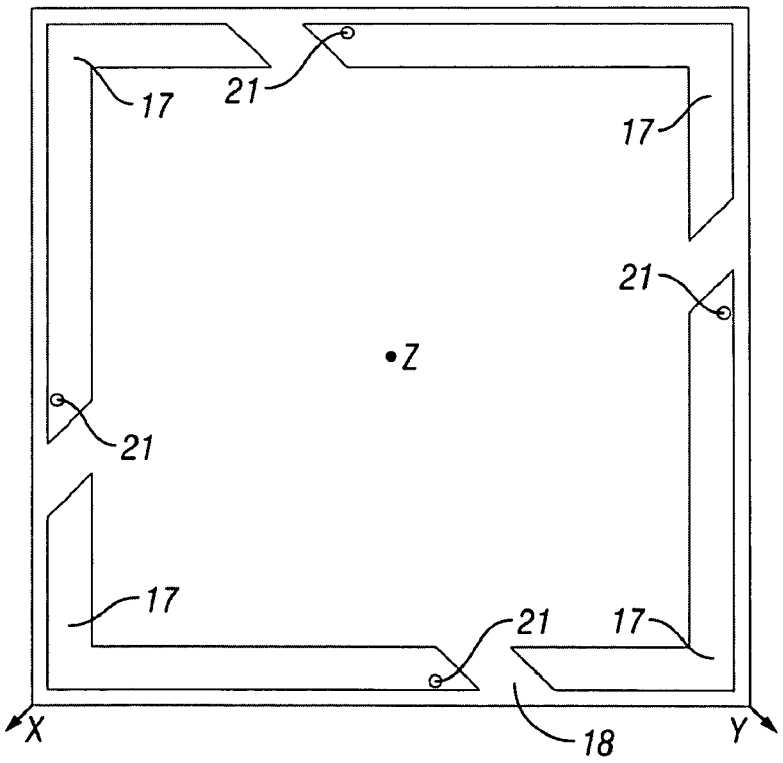
FIG. 22 is a top view of the antenna shown in FIG. 21 according to one embodiment.

The top radiating elements 17 with the maximum part of the near electric field are longer and are bended to fit on the surface of the top dielectric substrate 18. FIG. 22 is the top view of this embodiment. It illustrates the possible shape and position of top radiating elements 17. The length of the top radiating element 17 is adjusted to maintain the maximum radiation in the middle of the operational frequency band. Other features of this embodiment may be the same or different as the previous embodiment.

Figure 23:
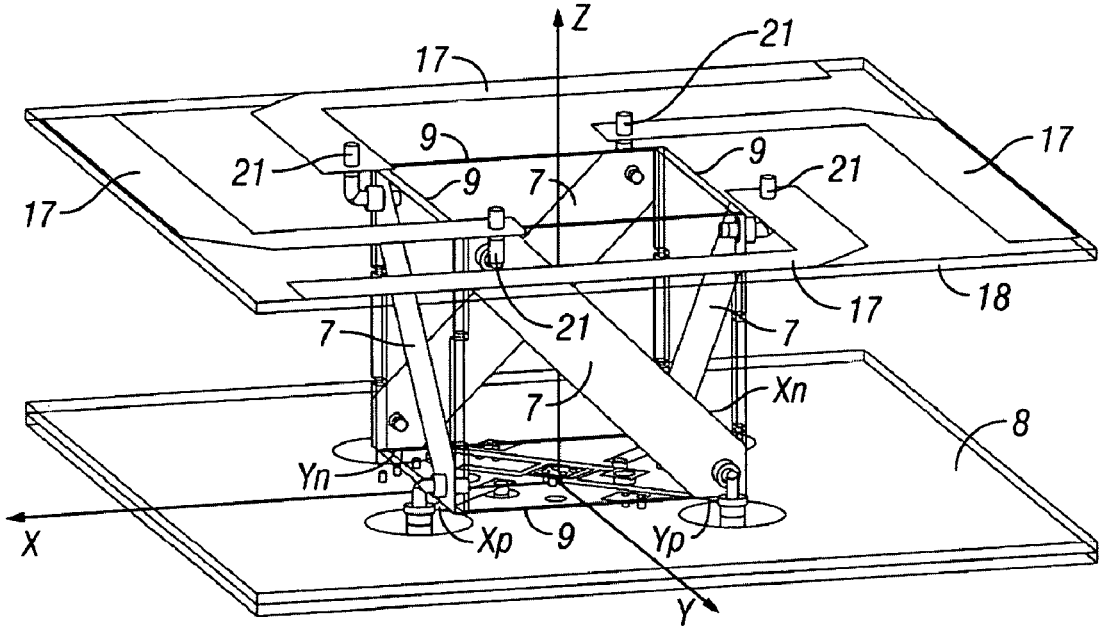
FIG. 23 is an isometric view of an antenna with four tilted side radiating elements according to one embodiment.
Figure 24:
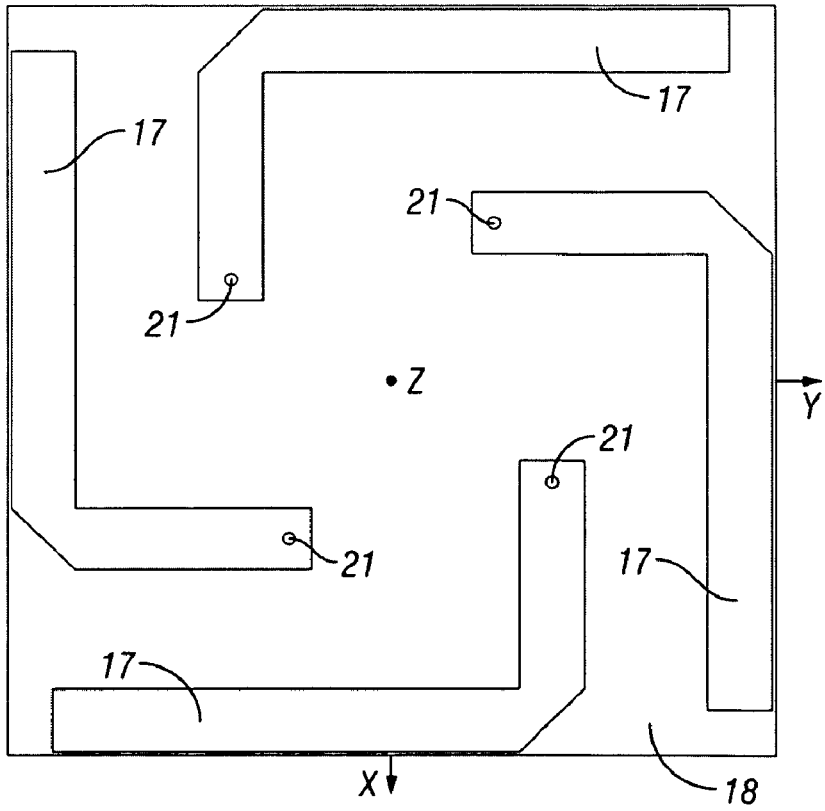
FIG. 24 is a top view of the antenna shown in FIG. 23 according to one embodiment.

According to another embodiment, as shown in FIG. 23, the weight and quantity the dielectric substrate material may be reduced. The side radiating elements 7 are divided similar to the embodiment shown in FIG. 9; however, the point of division is shifted even more, when compared to the previous embodiment. Now, the point of division is where the near magnetic field falls about 20% to about 40% from its maximum, preferably about 20% to about 30% from its maximum. The side radiating elements 7 become shorter and it reduces the size of the side dielectric substrates 9. The size of the side substrates 9 and the distance between them A1 is about λ/16 and may vary within about +/−30% or more. The top radiating elements 17 with the maximum part of the near electric field are longer and are bended to fit on the surface of the top dielectric substrate. FIG. 24 illustrates the top view of this embodiment. Positions of the top radiating elements 17 are rotated and shifted to connect with the shortened side radiating elements 7. The length of the top radiating elements 17 is adjusted to maintain the maximum radiation in the middle of operational frequency band. Other features of this embodiment may be the same or different from previous embodiments.

Figure 25:
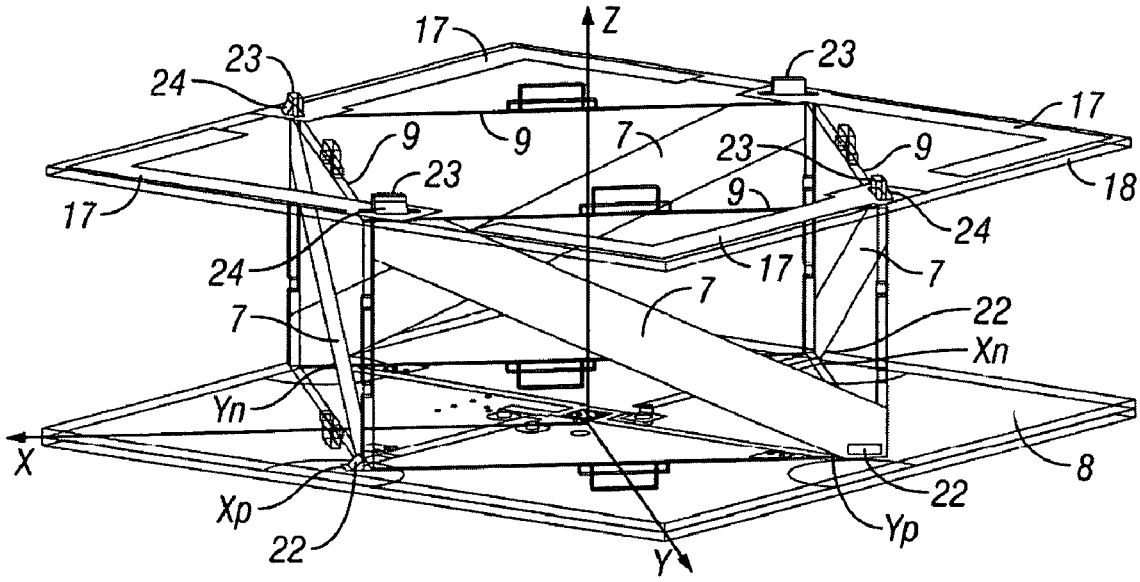
FIG. 25 is an isometric view of an antenna with four tilted side radiating elements according to one embodiment.

In another embodiment, presented in FIG. 25, the interconnection is simplified, thus making the antenna more rigid and stable and reducing the cost of producing the antenna. The position and layout of the side radiating elements 7 and the top radiating elements 17 are similar to the embodiment presented in FIG. 21. Differences include an interconnection between the side radiating elements 7 and the feeding circuit 8 and between the side radiating elements 7 and the corresponded top radiating elements 17.

The feeding circuit 8 has the output ports Xp, Yp, Xn, Yn as exposed conductive pads of a rectangular shape. The bottom part of the side radiating elements 7 end with exposed conductive pads of a rectangular shape also. Joints of the exposed pads of the feeding circuit 8 and of the corresponding side radiating elements 7 are electrically connected by solder material or conductive adhesive compound 22. An upscale view of one joint is shown in FIG. 30, according to one embodiment.

Figure 28:
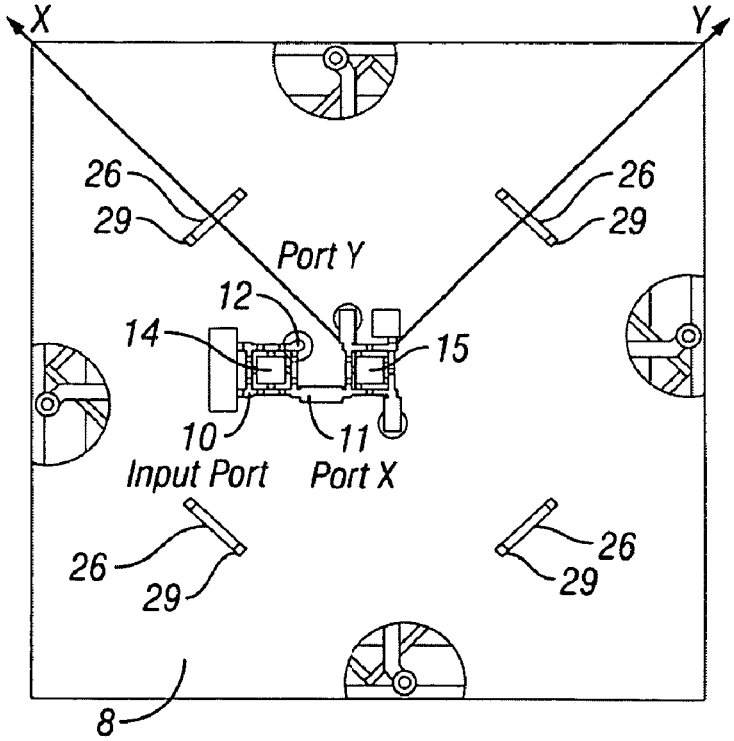
FIG. 28 is a bottom view of the antenna shown in FIG. 25 according to one embodiment.

To provide mechanical stability of the antenna structure, the substrate of the feeding circuit 8 has rectangular slots 29, which have a width that corresponds to the thickness of the side substrate 9. The positions of these slots 29 are illustrated in FIG. 28, a bottom view of this embodiment.

Figure 26:
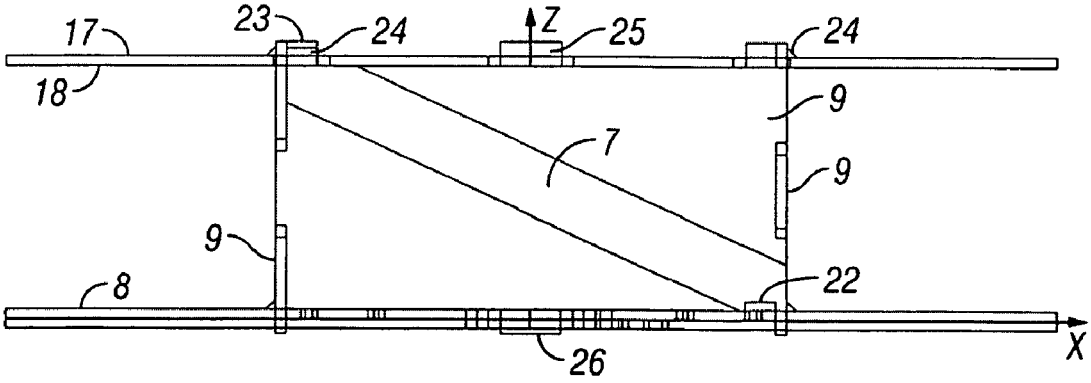
FIG. 26 is a side view of the antenna shown in FIG. 25 according to one embodiment.
Figure 27:
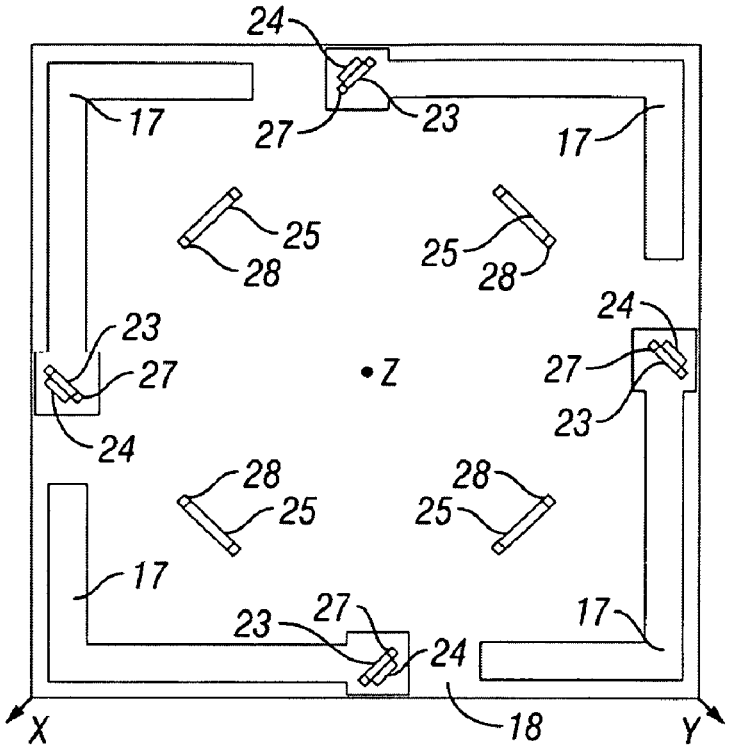
FIG. 27 is a top view of the antenna shown in FIG. 25 according to one embodiment.

The substrates 9 of the side radiating elements 7 have the protrusion 26 with the shape, size and position corresponding to the slots 29 in the substrate of the feeding circuit 8. FIG. 26, a side view, illustrates the shape of the side substrates 9. The protrusion 26 of the side substrate 9 passes through the slot 29 in the substrate of the feeding circuit 8. FIG. 30 presents an upscale view of a joint, according to one embodiment.

Figure 29:
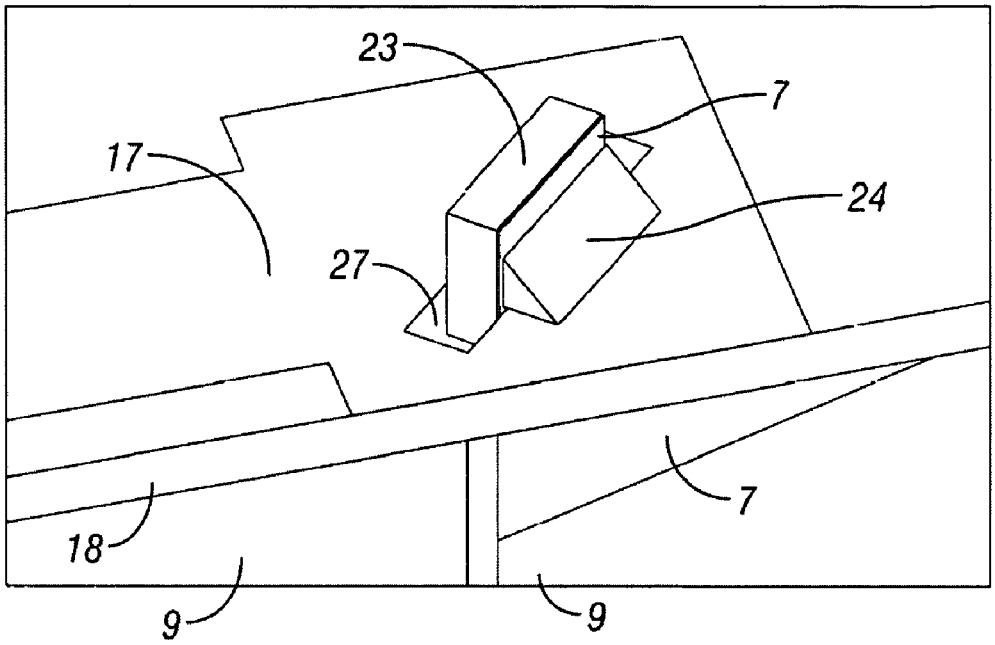
FIG. 29 is scaled up isometric view of the antenna shown in FIG. 25 showing an interconnection between a side radiating element and a top radiating element according to one embodiment.

Each top radiating element 17 has an exposed conductive pad of a rectangular shape. There are rectangular slots 27, cut through the top radiating elements 17 and the top substrate 18. The width of these slots 27 corresponds to the total thickness of the side substrate 9 with the side radiating element 7 and the length of these slots 27 is shorter than the size of the conductive pads. The top part of the side radiating elements 7 end with the protrusion 23, with the shape, size and position corresponding to the slots 27 in the top radiating elements 17. This protruded part 23 of the side radiating element 7 has exposed conductive pads of a rectangular shape. Protruded part 23 of the side radiating element 7 and its substrate 9 pass through the slot 27 at the corresponding top radiating element 17. Joints of exposed pads of the top radiating element 17 and of the corresponding side radiating elements 7 are electrically connected by solder material or a conductive adhesive compound 24. FIG. 29 presents an upscale view of one joint, according to one embodiment.

To provide mechanical stability of the antenna structure, the substrate 18 of the top radiating elements 17 has additional rectangular slots 28, which have a width that corresponds to the thickness of the side substrate 9. The substrates 9 of the side radiating elements 7 have the additional protrusion 25 with the shape, size and position corresponding to the slots 28 in the substrate 18 of the top radiating elements 17. The protrusion 25 of the side substrate 9 passes through the slot 28 in the substrate 18 of the top radiating elements 17. Other features of this embodiment may be the same or may be different than in previous embodiments.

Figure 31:
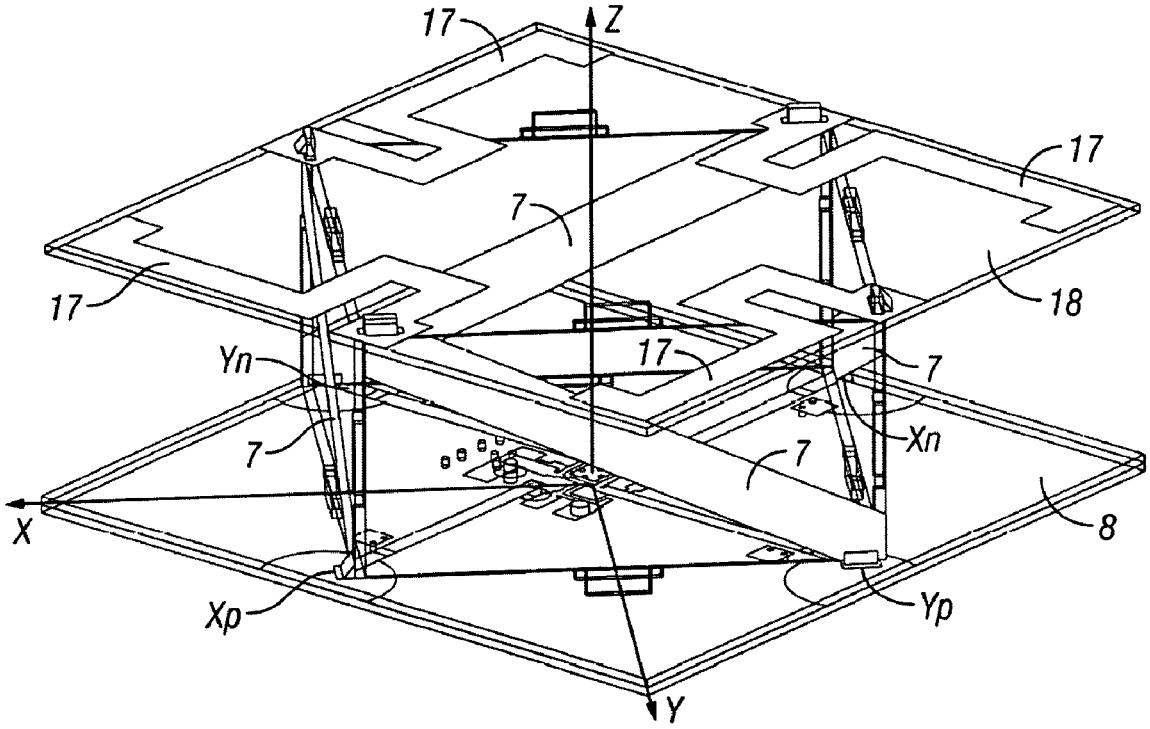
FIG. 31 is an isometric view of an antenna with four tilted side radiating elements according to one embodiment.

Another embodiment of an antenna is presented in FIG. 31, which uses the local magnetic and electric field distribution feature to improve the radiation quality while alloying for a reduced thickness of the antenna.

Figure 32:
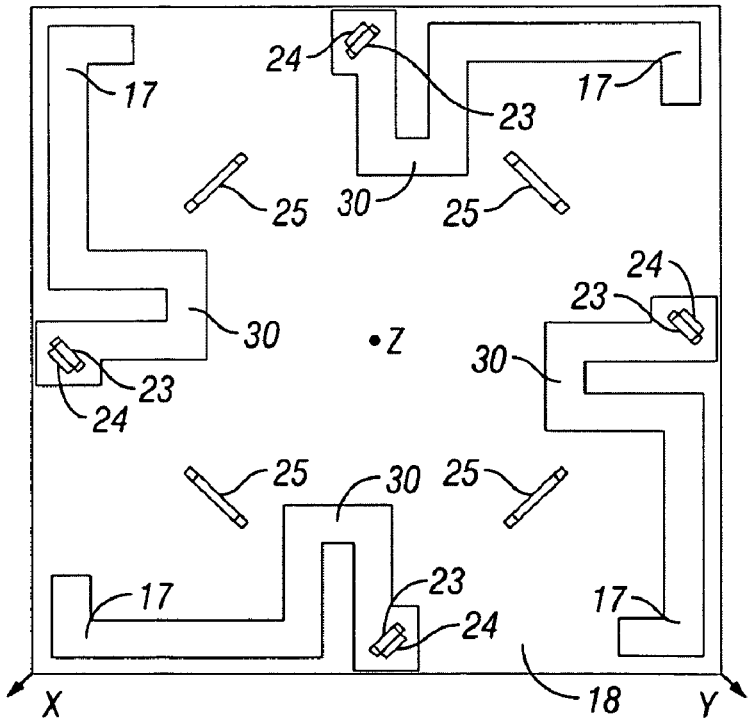
FIG. 32 is a top view of the antenna shown in FIG. 31 according to one embodiment.

In FIGS. 21 and 25, embodiments of the antenna were presented, and it was noted that a significant part of the near magnetic field is associated not only with the side radiating elements 7, but with the extended top radiating elements 17 as well. Mutual interaction between near electric and magnetic fields associated with the top radiating elements 17 increases the back radiation, cross polarization radiation, and reduces the front to back ratio of radiation. To improve the radiation quality in the embodiment presented in FIG. 31, the top radiating elements 17 have additional U-shape bending 30 in vicinity to the electrical interconnection 24 between the top radiating elements 17 and the side radiating elements 7. A better view of the top radiating elements 17 is illustrated in FIG. 32, a top view of this antenna, according to one embodiment. Such shape of the top radiating elements 17 repositions the near magnetic field exited by the top radiating elements 17 close to the near magnetic field, associated with the side radiation elements 7 and increases the front to back ratio of radiation with a reduction in the cross polarized component at the same time. The size of the antenna, e.g., the length, the width and the width of the conductive strip of the U-shape bending 30 and the size of the remaining part of the radiating elements 17, may be optimized for a better front to back ratio of radiation. The, length of the top radiating elements 17 may be adjusted to maintain the maximum radiation in the middle of the operational frequency band. The front to back ration of the radiated field is about 1 dB more in this embodiments than in embodiments presented in FIGS. 21 and 25. Other features of this embodiment may be the same or different than in other embodiments.

Figure 33:
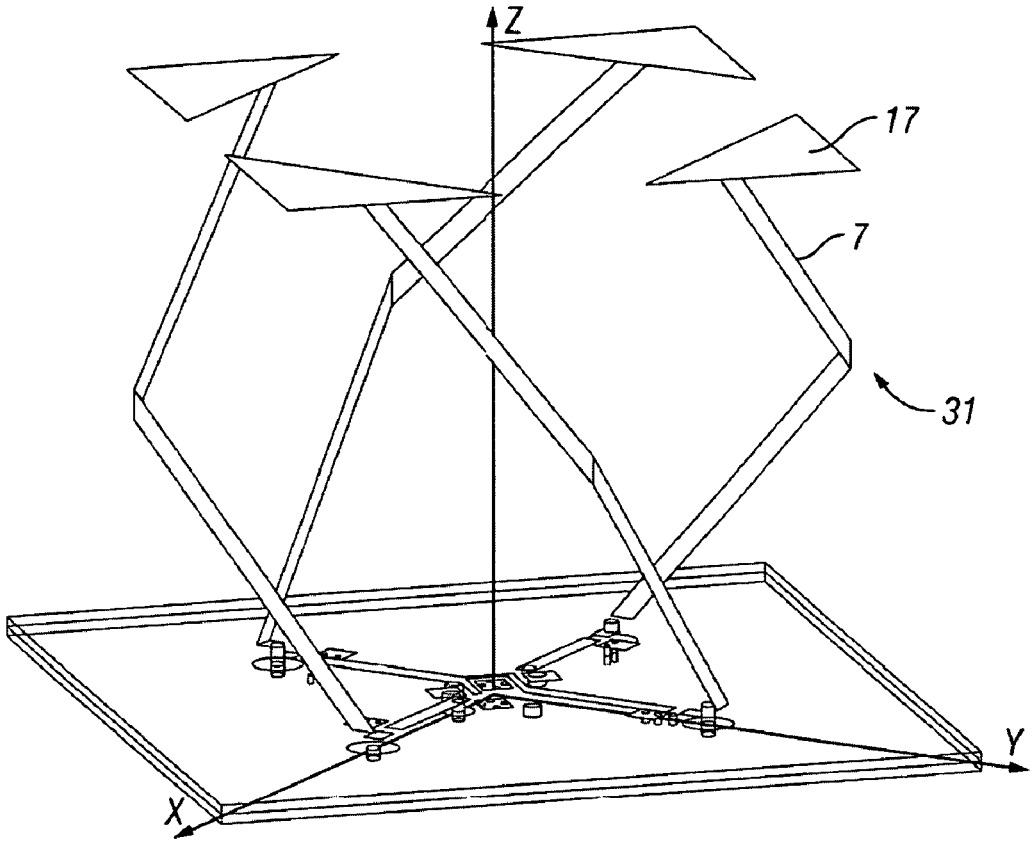
FIG. 33 is an isometric view of an antenna with four tilted side radiating elements with no supports according to one embodiment.

In one embodiment, as shown in FIG. 33, an antenna may include side radiating elements 7 and/or top radiating elements 17 which may not be supported by a supporting structure, such as not being supported by a substrate. In addition, the side radiating elements may include one or more bends 31, and the location of the one or more bends may be determined based on a distance of between about $\lambda/6$ and about $\lambda/32$, where $\lambda$ is a free space wavelength of radiation at a middle frequency of an operational frequency band of the antenna. Also, in some embodiments, the top radiating elements may be in a triangular shape as shown in FIG. 33, or in any other shape which provides for good reception/transmission, provides for more durability through use, and/or is easier to produce/manufacture.

Figure 34:
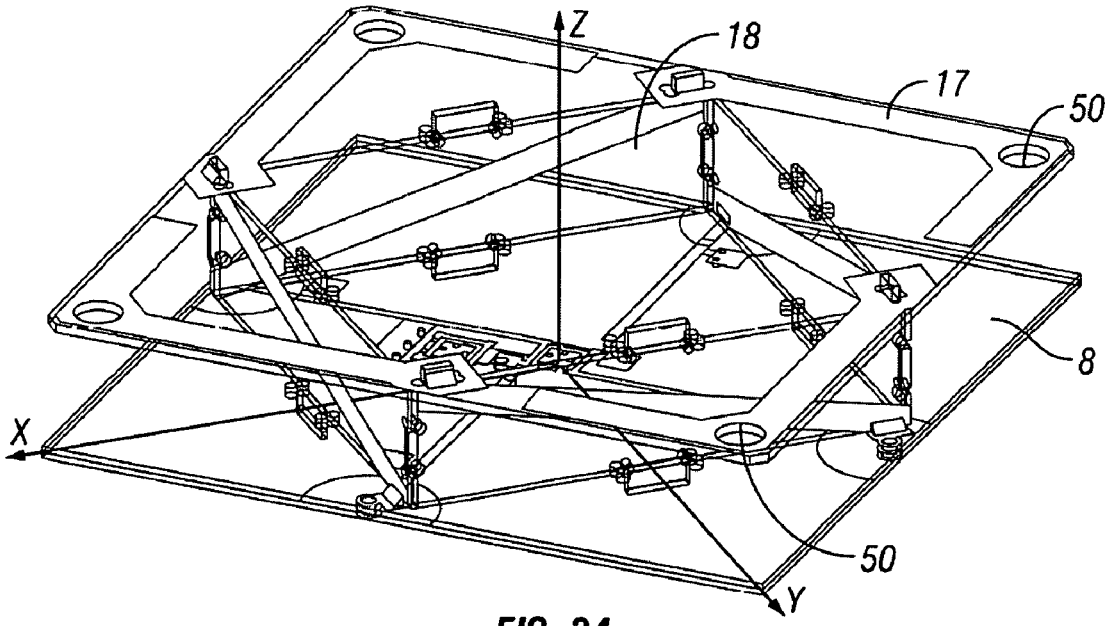
FIG. 34 is an isometric view of an antenna with passthrough slots for use during installation, according to one embodiment.

According to another embodiment, as shown in FIG. 34, an antenna may include passthrough slots 50, which may be used during installation of the antenna, such as to allow a screwdriver access to screws, an Allen wrench access to Allen head bolts, etc. In some more embodiments, passthrough slots may be present on portions of one or more substrates, surfaces, etc.

Figure 35:
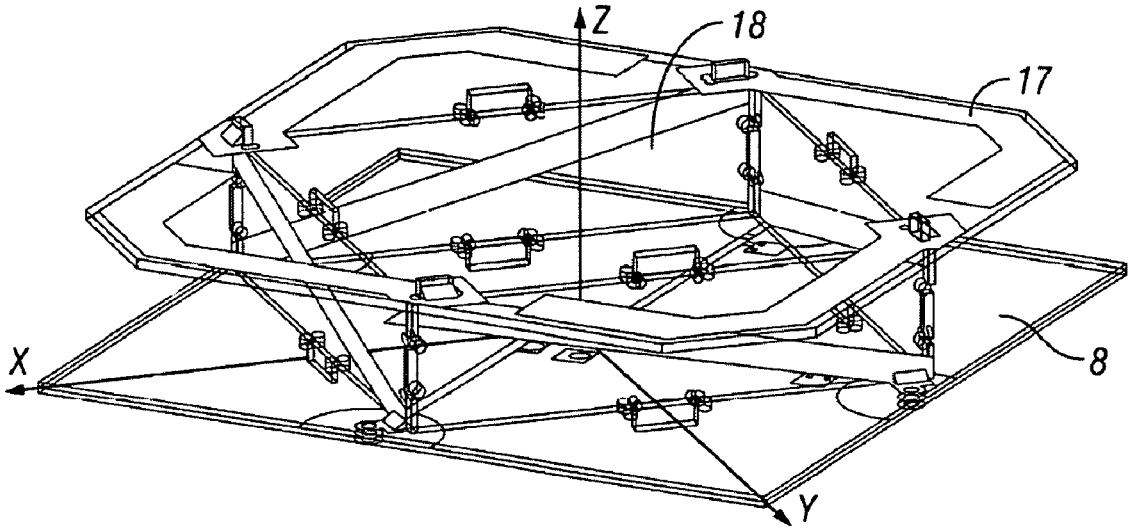
FIG. 35 is an isometric view of an antenna with a hexagonally shaped top substrate according to one embodiment.

In FIG. 35, an antenna is shown with a hexagonal shaped top substrate 18 according to one embodiment. The top substrate 18 may have any shape, some of which may be advantageous to the antenna design. For example, a hexagonally shaped top substrate 18 may allow the size of the protection cover to be reduced.

Figure 36:
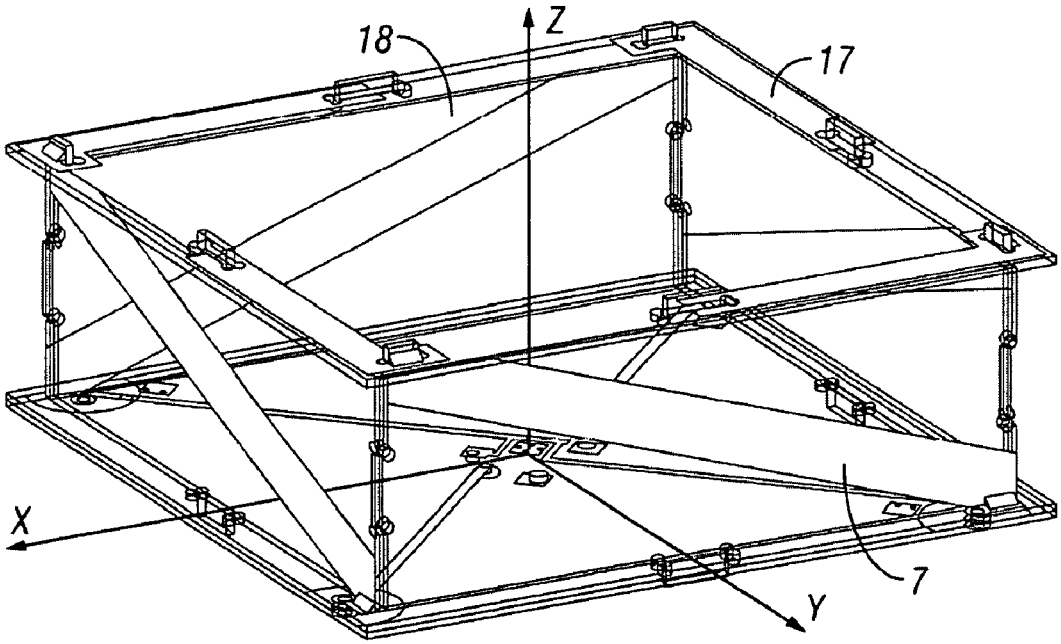
FIG. 36 is an isometric view of an antenna with a box-type shape according to one embodiment.

Now referring to FIG. 36, an antenna is shown with a box-type shape according to one embodiment. An antenna with this type of shape may provide higher gain within the same volume when compared to antennas with other shapes.

In some embodiments, a system may comprise a feeding circuit, a plurality of side radiating elements coupled to the feeding circuit, the side radiating elements having longitudinal axes including a median longitudinal axis for a side radiating element having a nonlinear profile oriented at angles of between about 10° and about 80° from a line perpendicular to an imaginary base plane extending across ends of the side radiating elements, and a plurality of top radiating elements electrically coupled to the side radiating elements, each of the top radiating elements having a different orientation than the associated side radiating element. These components of the system may be similar to those discussed in prior embodiments, such as the embodiment shown in FIG. 6.

Also, any of the descriptions and embodiments discussed above may be included in the system.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An antenna, comprising:

a plurality of elongated side radiating elements having longitudinal axes oriented at angles of between about 10 and about 80 degrees from a line perpendicular to an imaginary base plane extending across ends of the side radiating elements; and a plurality of top radiating elements each electrically coupled to an associated one of the side radiating elements, each of the top radiating elements extending in a direction that is not collinear with the longitudinal axis of the associated side radiating element.

2. The antenna of claim 1 , wherein the side radiating elements each lie along a unique side plane.

3. The antenna of claim 2, further comprising supporting substrates coupled to the side radiating elements, each of the substrates lying in the side plane of the associated side radiating element.

4. The antenna of claim 1, wherein the side radiating elements are tilted, relative to the line perpendicular to the imaginary base plane, towards the imaginary base plane in a direction opposite to a rotation of an electrical component of a field radiated by the antenna.

5. The antenna of claim 1, wherein a width of each of the side radiating elements in a direction perpendicular to the longitudinal axis thereof is between about $\lambda/400$ and about $\lambda/20$, where $\lambda$ is a free space wavelength of radiation at a middle frequency of an operational frequency band of the antenna.

6. The antenna of claim 1, wherein the top and associated side radiating element together form a radiating element, wherein a point of coupling of the top and side radiating elements is at a point along the radiating element where a near magnetic field of the radiating element is between about 60% and about 80% below a maximum near magnetic field of the radiating element.

7. The antenna of claim 6 wherein a distance between the imaginary base plane and a plane extending through couplings of the side radiating elements and the top radiating elements is between about $\lambda/6$ and about $\lambda/32$, where $\lambda$ is a free space wavelength of radiation at a middle frequency of an operational frequency band of the antenna.

8. The antenna of claim 1, wherein a width of each of the side radiating elements in a direction perpendicular to the longitudinal axis thereof is between about $\lambda/400$ and about $\lambda/20$, wherein the top radiating elements are elongated, wherein a width of each of the top radiating elements in a direction perpendicular to a longitudinal axis thereof is between about $\lambda/400$ and about $\lambda/20$, where $\lambda$ is a free space wavelength of radiation at a middle frequency of an operational frequency band of the antenna.

9. The antenna of claim 1, wherein the top radiating elements have a shape selected from a group consisting of straight, serpentine, round, triangular, and combinations thereof.

10. The antenna of claim 1, with the proviso that at least one of the side radiating elements and the top radiating elements are not coupled to a supporting substrate along an entire length thereof.

11. The antenna of claim 1, wherein the top and associated side radiating element together form a radiating element, wherein a point of coupling of the top and side radiating elements is at a point along the radiating element where a near magnetic field of the radiating element is between about 40% and about 60% below a maximum near magnetic field of the radiating element.

12. The antenna of claim 11 wherein a distance between the imaginary base plane and a plane extending through couplings of the side radiating elements and the top radiating elements is between about λ/6 and about λ/32, where λ, is a free space wavelength of radiation at a middle frequency of an operational frequency band of the antenna.

13. The antenna of claim 1, wherein a distance between the imaginary base plane and a plane extending through couplings of the side radiating elements and the top radiating elements is between about λ/6 and about λ/32, where λ is a free space wavelength of radiation at a middle frequency of an operational frequency band of the antenna.

14. The antenna of claim 1, wherein the top and associated side radiating element together form a radiating element, wherein a point of coupling of the top and side radiating elements is at a point along the radiating element where a near magnetic field of the radiating element is between about 20% and about 40% below a maximum near magnetic field of the radiating element.

15. The antenna of claim 14 wherein a distance between the imaginary base plane and a plane extending through couplings of the side radiating elements and the top radiating elements is between about λ/6 and about λ/32, where λ is a free space wavelength of radiation at a middle frequency of an operational frequency band of the antenna.

16. The antenna of claim 1, wherein the side radiating elements each have a protrusion extending at least partially through a supporting substrate of the top radiating elements, where the top radiating elements are each coupled to the protrusion of the associated side radiating element.

17. The antenna of claim 16 wherein a distance between the imaginary base plane and a plane extending through couplings of the side radiating elements and the top radiating elements is between about λ/6 and about λ/32, where λ is a free space wavelength of radiation at a middle frequency of an operational frequency band of the antenna.

18. An antenna, comprising:

a plurality of elongated side radiating elements each lying along a unique side plane and having longitudinal axes oriented at angles of between about 10 and about 80 degrees from a line perpendicular to an imaginary base plane extending across ends of the side radiating elements; and a plurality of top radiating elements each electrically coupled to an associated one of the side radiating elements and lying along a top plane.

19. The antenna of claim 18, further comprising supporting substrates coupled to the side radiating elements, each of the substrates lying in the side plane of the associated side radiating element.

20. The antenna of claim 18, wherein the side radiating elements are tilted, relative to the line perpendicular to the imaginary base plane, towards the imaginary base plane in a direction opposite to a rotation of an electrical component of a field radiated by the antenna.

21. The antenna of claim 18, wherein a width of each of the side radiating elements in a direction perpendicular to the longitudinal axis thereof is between about λ/400 and about λ/20, where λ is a free space wavelength of radiation at a middle frequency of an operational frequency band of the antenna.

22. The antenna of claim 18, wherein the top and associated side radiating element together form a radiating element, wherein a point of coupling of the top and side radiating elements is at a point along the radiating element where a near magnetic field of the radiating element is between about 60% and about 80% below a maximum near magnetic field of the radiating element.

23. The antenna of claim 18, wherein a width of each of the side radiating elements in a direction perpendicular to the longitudinal axis thereof is between about λ/400 and about λ/20, wherein the top radiating elements are elongated, wherein a width of each of the top radiating elements in a direction perpendicular to a longitudinal axis thereof is between about λ/400 and about λ/20, where λ is a free space wavelength of radiation at a middle frequency of an operational frequency band of the antenna.

24. The antenna of claim 18, wherein the top radiating elements have a shape selected from a group consisting of straight, serpentine, round, triangular, and combinations thereof.

25. The antenna of claim 18, with the proviso that at least one of the side radiating elements and the top radiating elements are not coupled to a supporting substrate along an entire length thereof.

26. The antenna of claim 18, wherein the top and associated side radiating element together form a radiating element, wherein a point of coupling of the top and side radiating elements is at a point along the radiating element where a near magnetic field of the radiating element is between about 40% and about 60% below a maximum near magnetic field of the radiating element.

27. The antenna of claim 26, wherein a distance between the imaginary base plane and a plane extending through couplings of the side radiating elements and the top radiating elements is between about λ/6 and about λ/32, where λ is a free space wavelength of radiation at a middle frequency of an operational frequency band of the antenna.

28. The antenna of claim 18 wherein a distance between the imaginary base plane and a plane extending through couplings of the side radiating elements and the top radiating elements is between about λ/6 and about λ/32, where λ is a free space wavelength of radiation at a middle frequency of an operational frequency band of the antenna.

29. The antenna of claim 18, wherein the top and associated side radiating element together form a radiating element, wherein a point of coupling of the top and side radiating elements is at a point along the radiating element where a near magnetic field of the radiating element is between about 20% and about 40% below a maximum near magnetic field of the radiating element.

30. The antenna of claim 29, wherein a distance between the imaginary base plane and a plane extending through couplings of the side radiating elements and the top radiating elements is between about λ/6 and about λ/32, where λ is a free space wavelength of radiation at a middle frequency of an operational frequency band of the antenna.

31. The antenna of claim 18, wherein the side radiating elements each have a protrusion extending at least partially through a supporting substrate of the top radiating elements, where the top radiating elements are each coupled to the protrusion of the associated side radiating element.

32. The antenna of claim 18, wherein a distance between the imaginary base plane and a plane extending through couplings of the side radiating elements and the top radiating elements is between about $\lambda/6$ and about $\lambda/32$, where $\lambda$ is a free space wavelength of radiation at a middle frequency of an operational frequency band of the antenna.

33. A system, comprising:

a feeding circuit;

a plurality of side radiating elements coupled to the feeding circuit, the side radiating elements having longitudinal axes oriented at angles of between about 10 and about 80 degrees from a line perpendicular to an imaginary base plane extending across ends of the side radiating elements; and a plurality of top radiating elements electrically coupled to the side radiating elements, each of the top radiating elements having a different orientation than the associated side radiating element.

34. The system of claim 33, wherein the top and associated side radiating element together form a radiating element, wherein a point of coupling of the top and side radiating elements is at a point along the radiating element where a near magnetic field of the radiating element is between about 60% and about 80% below a maximum near magnetic field of the radiating element.

35. The system of claim 33, wherein the top and associated side radiating element together form a radiating element, wherein a point of coupling of the top and side radiating elements is at a point along the radiating element where a near magnetic field of the radiating element is between about 40% and about 60% below a maximum near magnetic field of the radiating element.

36. The system of claim 33, wherein the top and associated side radiating element together form a radiating element, wherein a point of coupling of the top and side radiating elements is at a point along the radiating element where a near magnetic field of the radiating element is between about 20% and about 40% below a maximum near magnetic field of the radiating element.

* * * * *